US006123376A

United States Patent [19]

Yakushinji

[11] Patent Number: 6,123,376

[45] Date of Patent: Sep. 26, 2000

[54] LOAD CLAMPING AND LIFTING APPARATUS

[75] Inventor: Kuniaki Yakushinji, Ooita, Japan

[73] Assignee: Notsuunso Kabushikikaisha, Ooita, Japan

[21] Appl. No.: 09/374,994

[22] Filed: Aug. 16, 1999

Related U.S. Application Data

[62] Division of application No. 08/967,733, Nov. 12, 1997.

[30] Foreign Application Priority Data

| | | | |
|---|---|---|---|
| Jan. 27, 1997 | [JP] | Japan | 9-28377 |
| Apr. 23, 1997 | [JP] | Japan | 9-121633 |
| Aug. 12, 1997 | [JP] | Japan | 9-231843 |

[51] Int. Cl.[7] ..... B66C 1/42

[52] U.S. Cl. ..... 294/110.1; 294/118

[58] Field of Search ..... 294/63.1, 81.61, 294/95, 97, 110.1, 110.2, 118, 119

[56] References Cited

U.S. PATENT DOCUMENTS

| | | | |
|---|---|---|---|
| 1,506,827 | 9/1924 | Gellert | 294/110.2 X |
| 2,629,627 | 2/1953 | Stone | 294/110.1 |
| 3,697,118 | 10/1972 | Johnstone et al. | 294/110.1 |
| 3,768,853 | 10/1973 | Rennie | 294/110.1 |

FOREIGN PATENT DOCUMENTS

| | | |
|---|---|---|
| 80122 | 6/1951 | Czechoslovakia . |
| 236296 | 6/1986 | Germany . |
| 45-20020 | 8/1970 | Japan . |
| 48-36571 | 9/1971 | Japan . |
| 54-159572 | 4/1978 | Japan . |
| 1008137 | 3/1983 | U.S.S.R. . |
| 1009963 | 4/1983 | U.S.S.R. . |
| 1283210 | 1/1987 | U.S.S.R. . |
| 921011 | 3/1963 | United Kingdom . |

*Primary Examiner*—Johnny D. Cherry
*Attorney, Agent, or Firm*—Armstrong, Westerman, Hattori, McLeland & Naughton

[57] ABSTRACT

A load lifting apparatus suitable for use in a materials-handling operation, which enables loads of various shapes and structures, e.g. concrete products, to be clamped by a one-touch simple operation despite an extremely simple structure and allows the loads to be released by a one-touch simple operation at desired places after they have been lifted and moved thereto. The apparatus includes a link mechanism (14) in which a pair of clamping members (1 and 2) and a plurality of members (4, 5, 8, 8-1, 8-2) are supported by a plurality of pivot shafts. The upper part of the link mechanism (14) is arranged to be capable of being lifted and lowered by a lifting device. The clamping members (1 and 2) rotate about a pivot shaft (3 or 3') in response to vertical extension and contraction of the link mechanism (14), thereby enabling an object (11) to be grasped by the distal end portions of the clamping members (1 and 2) directly or indirectly through grab members (10) by the extension of the link mechanism (14), and allowing the object (11) to be released therefrom by the contraction of the link mechanism (14). The apparatus has a lock-unlock mechanism (20, 30, 40, 50, 60, or 70) actuated in response to the vertical extension and contraction of the link mechanism (14), caused by vertical movement of the lifting device, to lock the clamping members in respective predetermined positions of rotation about the pivot shaft and to unlock the clamping members in response to the vertical movement of the lifting device.

1 Claim, 18 Drawing Sheets

LOAD CLAMPING AND LIFTING APPARATUS

This application is a divisional of prior application Ser. No. 08/967,733 filed Nov. 12, 1997.

BACKGROUND OF THE INVENTION

The present invention relates to a load lifting apparatus suitable for use in a materials-handling operation, which enables loads (particularly, heavy objects) of various shapes and structures to be readily clamped and allows the loads to be readily released at a desired position after they have been lifted and moved thereto.

To lift and move to a desired position a heavy load, e.g. a concrete block or pipe or a steel pipe, the following method has heretofore been employed: A wire rope or chain is wound around the load, and the other end of the wire rope or chain is engaged with a hook or the like of materials-handling equipment. In this state, the load is lifted and moved to the desired position, and then the wire rope or chain is removed from the load.

Some loads are lifted and moved to a desired position as follows: Engagement members, e.g. bolts or hooks, for engaging a wire rope or chain have previously been attached to the loads, or the loads have been arranged such that these engagement members can be attached thereto. In a materials-handling operation, a wire rope or chain is engaged with engagement members previously attached to a load or engagement members attached thereto at the site of work, and the other end of the wire rope or chain is engaged with a hook of materials-handling equipment. After the load has been lifted and moved to a desired position, the wire rope or chain is disengaged from the engagement members attached to the load.

Materials-handling equipment, e.g. a crane, has a lifting apparatus that has clamping members for clamping a load as an object to be lifted. The clamping members of the lifting apparatus are opened by human power or using a jig, e.g. a hydraulic device, to pick up a load to be lifted. Then, the load is lifted and moved to a desired position by the materials-handling equipment. At the destination, the clamping members are removed from the load by human power or using a jig, e.g. a hydraulic device.

The above-described conventional method in which a wire rope or chain is wound around a load or engaged with !engagement members by a manual operation suffers from the problem that the materials-handling operation is difficult because it is carried out by a manual operation and, at the same time, it is dangerous at a shaky work site.

The conventional method in which the clamping members of materials-handling equipment are operated by human power or using a jig, e.g. a hydraulic device, suffers from the problem that it is difficult to operate the clamping members at a job site and, at the same time, the use of a hydraulic device or other similar jig involves a mechanical failure and causes the overall size of the equipment to increase.

If such a jig as a hydraulic device is mounted on a vehicle or the like, it occupies an installation space, resulting in a reduction of the space for loading an object to be lifted, and also causing the cost of the equipment to increase.

SUMMARY OF THE INVENTION

In view of the above-described circumstances, an object of the present invention is to provide a load lifting apparatus suitable for use in a materials-handling operation, which enables loads of various shapes and structures, e.g. concrete products, to be clamped by a one-touch simple operation despite an extremely simple structure and allows the loads to be released by a one-touch simple operation at desired places after they have been lifted and moved thereto.

To solve the above-described problem, the present invention provides a load clamping and lifting apparatus including a link mechanism (14) in which a pair of clamping members (1 and 2) and a plurality of members (4, 5, 8, 8-1, 8-2) are supported by a plurality of pivot shafts. The upper part of the link mechanism (14) is arranged to be capable of being lifted and lowered by a lifting device. The clamping members (1 and 2) rotate about a pivot shaft (3 or 3') in response to vertical extension and contraction of the link mechanism (14), thereby enabling an object (11) to be grasped by the distal end portions of the clamping members (1 and 2) directly or indirectly through grab members (10) by the extension of the link mechanism (14), and allowing the object (11) to be released therefrom by the contraction of the link mechanism (14). The load clamping and lifting apparatus has a lock-unlock mechanism (20, 30, 40, 50, 60, or 70) that is actuated in response to the vertical extension and contraction of the link mechanism (14), which is caused by vertical movement of the lifting device, to lock the clamping members in respective predetermined positions of rotation about the pivot shaft and to unlock the clamping members in response to the vertical movement of the lifting device.

In the load clamping and lifting apparatus, the lock-unlock mechanism (20, 30, or 40) has a frame (21, 31, or 41) provided with a guide groove; a latch (24, 34, or 44); and a shunting member (23, 33, or 43). The frame (21, 31, or 41) is attached to a clamping member (1 or 2) or other member (4 or 5) constituting the link mechanism (14) or to a member (8, 8-1, or 8-2) that moves in response to extension and contraction of the link mechanism. The guide groove (22, 32, or 42) is pierced with a projecting pin (15) provided on a clamping member (1 or 2) or other member (4 or 5) constituting the link mechanism (14) or on a member (8, 8-1, or 8-2) that moves in response to extension and contraction of the link mechanism. The projecting pin (15) is movable in the guide groove (22, 32, or 42). The latch (24, 34, or 44) and the shunting member (23, 33, or 43) are rotatably supported on the frame (21, 31, or 41) by respective pivot shafts (pins 25, 35, or 45; 27,.37, or 47) such that the distal ends of the latch and the shunting member project into the guide groove (22, 32, or 42) so that the latch and shunting member are each rotated by movement of the projecting pin (15) in one direction, and rotation of the latch and shunting member caused by movement of the projecting pin (15) in the opposite direction is limited by respective limiting devices (stopper pin 26, 36, or 46; pin 27, 37, or 47). The guide groove (22, 32, or 42) is formed such that after the projecting pin (15) has moved in one direction past the latch (24, 34, or 44), movement of the projecting pin (15) in the opposite direction is limited by the latch (24, 34, or 44), and when the projecting pin (15) moves in the opposite direction after moving in the one direction by a predetermined distance past the shunting member (23, 33, or 43), the shunting member (23, 33, or 43) enables the projecting pin (15) to bypass the latch (24, 34, or 44) and to move in the opposite direction (see FIGS. 2, 4 and 6).

In the load clamping and lifting apparatus, the lock-unlock mechanism (50) has a frame (51) provided with a guide groove (52); a latch projection (54) integrally formed with the frame (51) such that the latch projection (54) projects into the guide groove (52); and a shunting member (53). The frame (51) is attached to a clamping member (1 or 2) or other member (4 or 5) constituting the link mechanism (14) or to a member (8, 8-1, or 8-2) that moves in response to extension and contraction of the link mechanism. The guide groove (52) is pierced with a projecting pin (.15) provided on a clamping member (1 or 2) or other member (4 or 5) constituting the link mechanism (14) or on a member (8, 8-1, or 8-2) that moves in response to extension and contraction of the link mechanism. The projecting pin (15) is movable in the guide groove (52). The shunting member (53) is rotatably supported on the frame (51) by a pivot shaft (pin 57) such that the distal end of the shunting member (53) projects into the guide groove (52) so that the shunting member (53) is rotated by movement of the projecting pin (15) in one direction, and rotation of the shunting member (53) caused by movement of the projecting pin (15) in the opposite direction is limited by a limiting device (stopper pin 56). The guide groove (52) is formed such that after the projecting pin (15) has moved in one direction past the latch projection (54), movement of the projecting pin (15) in the opposite direction is limited by the latch projection (54), and when the projecting pin (15) moves in the opposite direction after moving in the one direction by a predetermined distance past the shunting member (53), the shunting member (53) enables the projecting pin (15) to bypass the latch projection (54) and to move in the opposite direction (see FIGS. 7 and 8).

In the load clamping and lifting apparatus, the lock-unlock mechanism (60 or 70) has a frame (61 or 71) provided with a straight-line shaped guide groove (62 or 72); a latch member (63 or 73) having a latch projection (63*a* or 73*a*) and a projection (63*b* or 73*b*) for rotation; a limiting device (stopper 65 or 75) for limiting rotation in a predetermined direction of the latch member (63 or 73); and a holding device (magnet 66 or 76) for holding the latch member (63 or 73) in a predetermined rotational position. The frame (61 or 71) is attached to a clamping member (1 or 2) or other member (4 or 5) constituting the link mechanism (14) or to a member (8, 8-1, or 8-2) that moves in response to extension and contraction of the link mechanism. The guide groove (62 or 72) is pierced with a projecting pin (15) provided on a clamping member (1 or 2) or other-member (4 or 5) constituting the link mechanism (14) or on a member (8, 8-1, or 8-2) that moves in response to extension and contraction of the link mechanism. The projecting pin (15) is movable in the guide groove (62 or 72). The latch member (63 or 73) is rotatably supported on the frame (61 or 71) by a pivot shaft (64 or 74) such that the distal end of the latch projection (63*a* or 73*a*) projects into the guide groove (62 or 72) so that the latch member (63 or 73) is rotated by movement of the projecting pin (15) in one direction, and such that the projection (63*b* or 73*b*) for rotation extends across the guide groove (62 or 72), and rotation of the latch member (63 or 73) caused by movement of the projecting pin (15) in the opposite direction is limited by the limiting device (stopper 65 or 75). The latch member (63 or 73) is arranged such that after the projecting pin (15) has moved in the guide groove (62 or 72) in one direction past the latch projection (63*a* or 73*a*), movement of the projecting pin (15) in the opposite direction is limited by the latch projection (63*a* or 73*a*), and when the projecting pin (15) pushes the projection (63*b* or 73*b*) for rotation after moving further in the one direction, the latch member (63 or 73) rotates greatly to a predetermined position and is held at this position by the holding device (magnet 66 or 76), and thereafter, the latch member (63 or 73) is released from the holding device (magnet 66 or 76) by movement of the projecting pin (15) in the opposite direction and rotated to a position where rotation of the latch member (63 or 73) is limited by the limiting device (stopper 65 or 75) (see FIGS. 9 to 14).

In the load clamping and lifting apparatus, when the pair of clamping members (1 and 2) constituting the link mechanism (14) are not locked by the lock-unlock mechanism (20, 30, or 40), a lifting operation of the lifting device causes the lower ends of the clamping members (1 and 2) to move toward each other to grasp an object lying therebetween directly or indirectly through grab members (10) (see FIGS. 1, 2 and 3).

In the load clamping and lifting apparatus, when the pair of clamping members (1 and 2) constituting the link mechanism (14) are not locked by the lock-unlock mechanism (20), a lifting operation of the lifting device causes the lower ends of the clamping members (1 and 2) to move away from each other to press the inner wall of an object (11) lying outside the clamping members (1 and 2) directly or indirectly through grab members (10), thereby grasping the object (11) (see FIG. 15).

In the load clamping and lifting apparatus, a pair of link mechanisms (14 and 14) are provided to extend between a pair of upper and lower support members (8-1 and 8-2) such that the link mechanisms lie in a side-by-side relation to each other at a predetermined distance therebetween. When the pair of clamping members (1 and 2) constituting each of the link mechanisms (14 and 14) are not locked by the lock-unlock mechanism (20), a lifting operation of the lifting device causes the lower ends of the clamping members of each link mechanism to move toward each other so that side walls of an object (11) which are at the predetermined distance from each other are grasped by the lower ends of the clamping members (1 and 2) of the pair of link mechanisms, respectively, directly or indirectly through grab members (10) (see FIG. 16).

In the load clamping and lifting apparatus, a pair of link mechanisms (14 and 14) are provided to extend between a pair of upper and lower support members (8-1 and 8-2) at both ends, respectively, of the pair of support members. When the pair of clamping members (1 and 2) constituting each of the link mechanisms (14 ad 14) are not locked by the lock-unlock mechanism (30), a lifting operation of the lifting device causes the lower ends of the clamping members (1 and 2) of each link mechanism to move toward each other to grasp an object (11) lying therebetween directly or indirectly through grab members (10) (see FIGS. 17 and 18).

DESCRIPTION OF THE PREFERRED EMBODIMENTS

Embodiments of the present invention will be described below with reference to the accompanying drawings.

Figure 1:
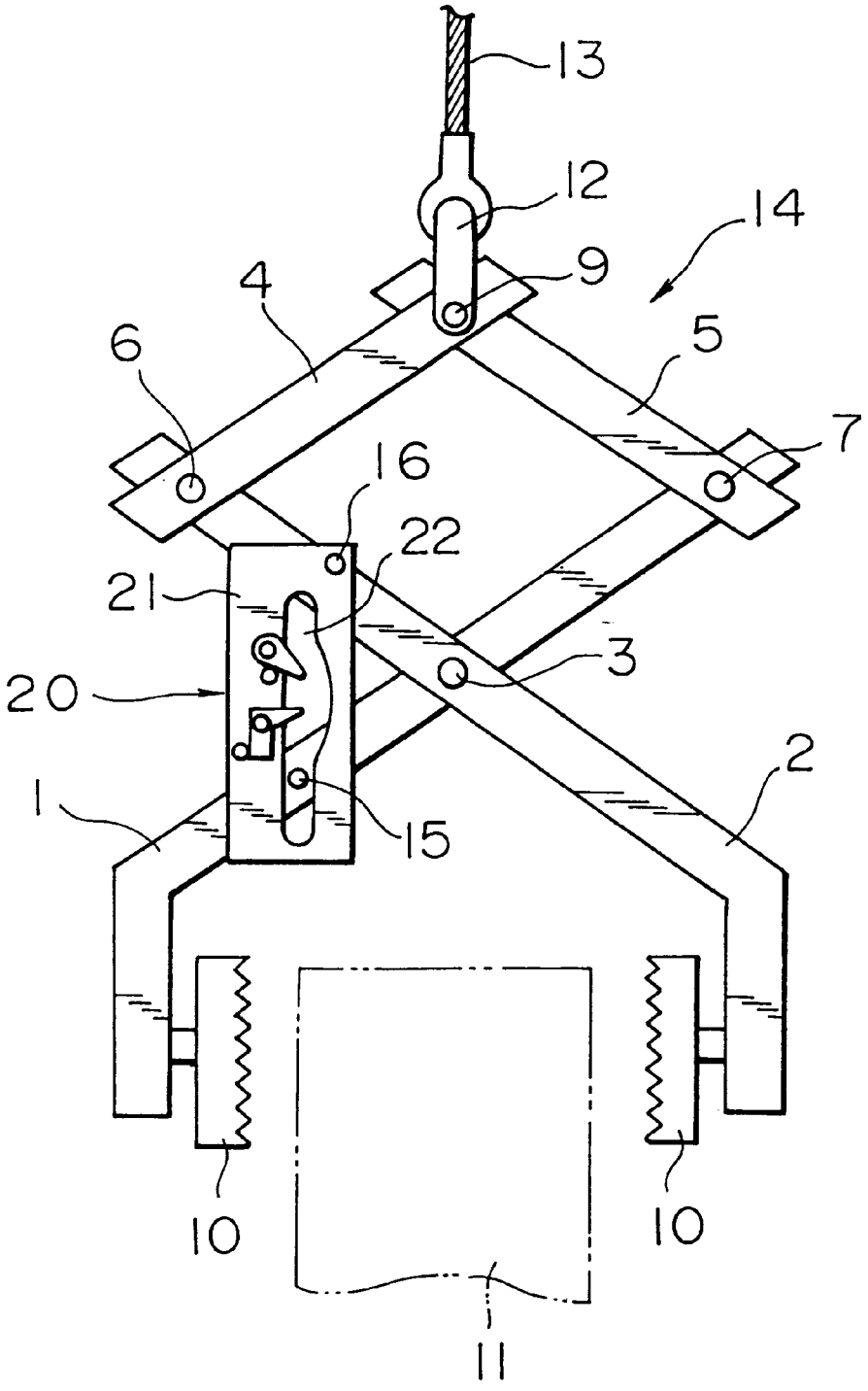
FIG. 1 is a diagram showing an example of a structure of a load lifting apparatus according to the present invention.

FIG. 1 is a diagram showing a structure of a load lifting apparatus according to the present invention. The load lifting apparatus has a pair of clamping members 1 and 2. The clamping member 1 and the clamping member 2 are connected by a pivot shaft 3 such that the clamping members 1 and 2 intersect each other in an X-shape at the pivot shaft 3 and are rotatable about it.

The lower end of a link member 4 and the lower end of a link member 5 are connected to the upper ends of the clamping members 2 and 1 by pivot shafts 6 and 7, respectively, such that the link members 4 and 5 are rotatable about the respective pivot shafts 6 and 7. The upper ends of the link members 4 and 5 are connected by a pivot shaft 9 such that these upper ends intersect each other at the pivot shaft 9 and are rotatable about it.

The clamping member 1, the clamping member 2, the link member 4 and the link member 5 constitute a link mechanism 14 supported at four points (pivot shafts 3, 6, 7 and 9).

Grab members 10 are secured to the mutually opposing lower end portions of the clamping members 1 and 2. A suspended ring 12 is secured to the pivot shaft 9.

A wire rope 13, for example, is engaged with the suspended ring 12. The suspended ring 12 is lifted and lowered through the wire rope 13, thereby enabling an object (load) 11 to be clamped between the grab members 10 and released at a desired position after the object 11 has been lifted and moved thereto, as described later in detail. More specifically, when the suspended ring 12 is lifted, the link mechanism 14 extends vertically, causing the lower ends of the clamping members 1 and 2 to move toward each other. Consequently, the object 11 is clamped between the grab members 10. Conversely, when the suspended ring 12 is lowered after the object 11 has been placed, for example, on the ground, the link mechanism 14 contracts vertically, causing the lower ends of the clamping members 1 and 2 to move away from each other, thereby releasing the object 11.

A lock-unlock mechanism 20 locks the clamping members 1 and 2 in respective predetermined positions of rotation about the pivot shaft 3 and unlocks them in response to the vertical extension and contraction of the link mechanism 14. The lock-unlock mechanism 20 is provided to extend between the clamping members 1 and 2 at a position closer to the left end of the link mechanism 14 than the pivot shaft 3.

Figure 2:
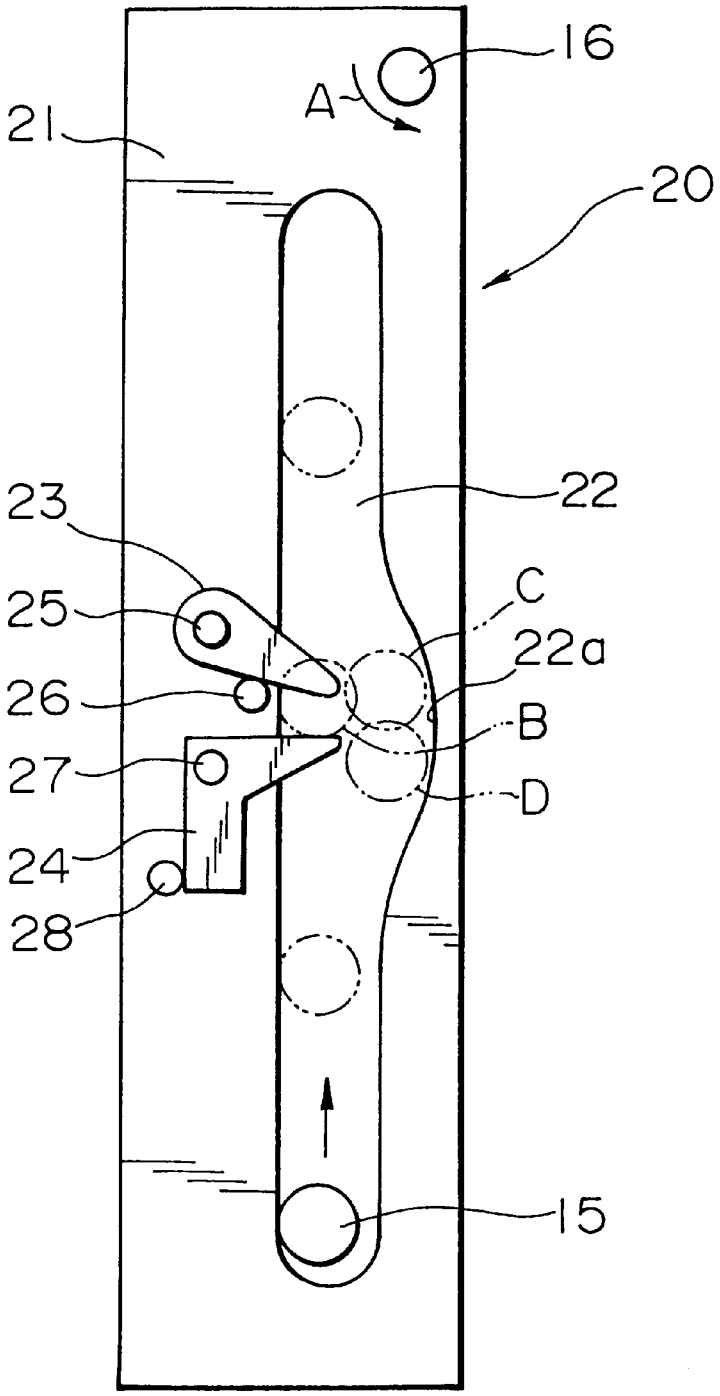
FIG. 2 is a diagram showing an example of a structure of a lock-unlock mechanism used in a load lifting apparatus according to the present invention.

FIG. 2 is a diagram showing the structure of the lock-unlock mechanism 20 in detail. The lock-unlock mechanism 20 has a plate-shaped frame 21 provided with a guide groove 22; a shunting member 23; and a latch 24.

The upper-right end portion of the frame 21 is rotatably attached to the clamping member 2 by a pin 16. The guide groove 22 is pierced with a projecting pin 15, provided on the clamping member 1. The projecting pin 15 is movable along the guide groove 22.

The shunting member 23 is rotatably attached to the frame 21 by a pin 25. The distal end of the shunting member 23 projects into the guide groove 22. Clockwise rotation of the shunting member 23 is limited by a stopper pin 26.

The latch 24 is rotatably attached to the frame 21 by a pin 27. The distal end of the latch 24 projects into the guide groove 22. Clockwise rotation of the latch 24 is limited by a stopper pin 28.

A recessed portion 22*a* is formed in a side wall of the guide groove 22 at a position facing opposite to the distal ends of the shunting member 23 and the latch 24. The distance between the recessed portion 22*a* and the distal ends of the shunting member 23 and the latch 24 is set equal to the width of a space through which the projecting pin 15 can pass.

The frame-21 is urged to rotate in the direction of the arrow A about the pin 16 by its own weight. If the suspended ring 12 is lowered in the state shown in FIG. 1, the link mechanism 14 contracts vertically, causing the projecting pin 15 to move upward in the guide groove 22. When the projecting pin 15 comes in contact with the latch 24, the latch 24 rotates counterclockwise about the pin 27. After the projecting pin 15 has passed the latch 24, the latch 24 rotates about the pin 27 by its own weight to return to the position where it abuts on the stopper pin 28.

When the suspended ring 12 is raised in this state, the link mechanism 14 is caused to extend vertically, and the projecting pin 15 is also caused to move downward in the guide groove 22. However, the downward movement of the projecting pin 15 is blocked by the latch 24 (see B in FIG. 2). Consequently, the clamping members 1 and 2 are stopped from rotating about the pivot shaft 3. Thus, the distance between the mutually opposing lower ends of the clamping members 1 and 2 is maintained (locked) in this state.

At this time, the projecting pin 15 surely lies on the latch 24 because the frame 21 is urged to rotate in the direction of the arrow A about the pin 16 by its own weight.

With the above state being maintained, the link mechanism 14 is moved to the position of the object 11. Then, the suspended ring 12 is lowered such that the object 11 lies between the clamping members 1 and 2 of the link mechanism 14.

The lowering of the suspended ring 12 causes the projecting pin 15 to push up the shunting member 23. Consequently, the shunting member 23 rotates counterclockwise about the pin 25. After the projecting pin 15 has passed the shunting member 23, the shunting member 23 returns by its own weight until it comes in contact with the stopper pin 26.

When the suspended ring 12 is lifted in this state, the link mechanism 14 extends vertically, causing the projecting pin 15 to move downward through the space between the recessed portion 22*a* of the guide groove 22 and the distal ends of the shunting member 23 and the latch 24 (see C and D in FIG. 2). Consequently, the grab members 10 move toward each other to clamp the object 11.

After being clamped as described above, the object 11 is lifted and moved to a desired place. Then, the suspended ring 12 is lowered. Consequently, the projecting pin 15 moves upward in the guide groove 22 as in the case of the above, and at the same time, the distance between the grab members 10 enlarges. Thus, the object 11 is released.

When the suspended ring 12 is lifted after the projecting pin 15 has further moved upward past the latch 24, the projecting pin 15 is prevented from moving downward by the latch 24. Accordingly, the distance between the mutually opposing lower ends of the clamping members 1 and 2, that is, the distance between the grab members 10, is maintained (locked) at a value determined by the position of the projecting pin 15 (see B in FIG. 2).

At this time, the projecting pin 15 surely lies on the latch 24 because the frame 21 is urged to rotate in the direction of the arrow A about the pin 16 by its own weight as in the case of the above.

Figure 3:
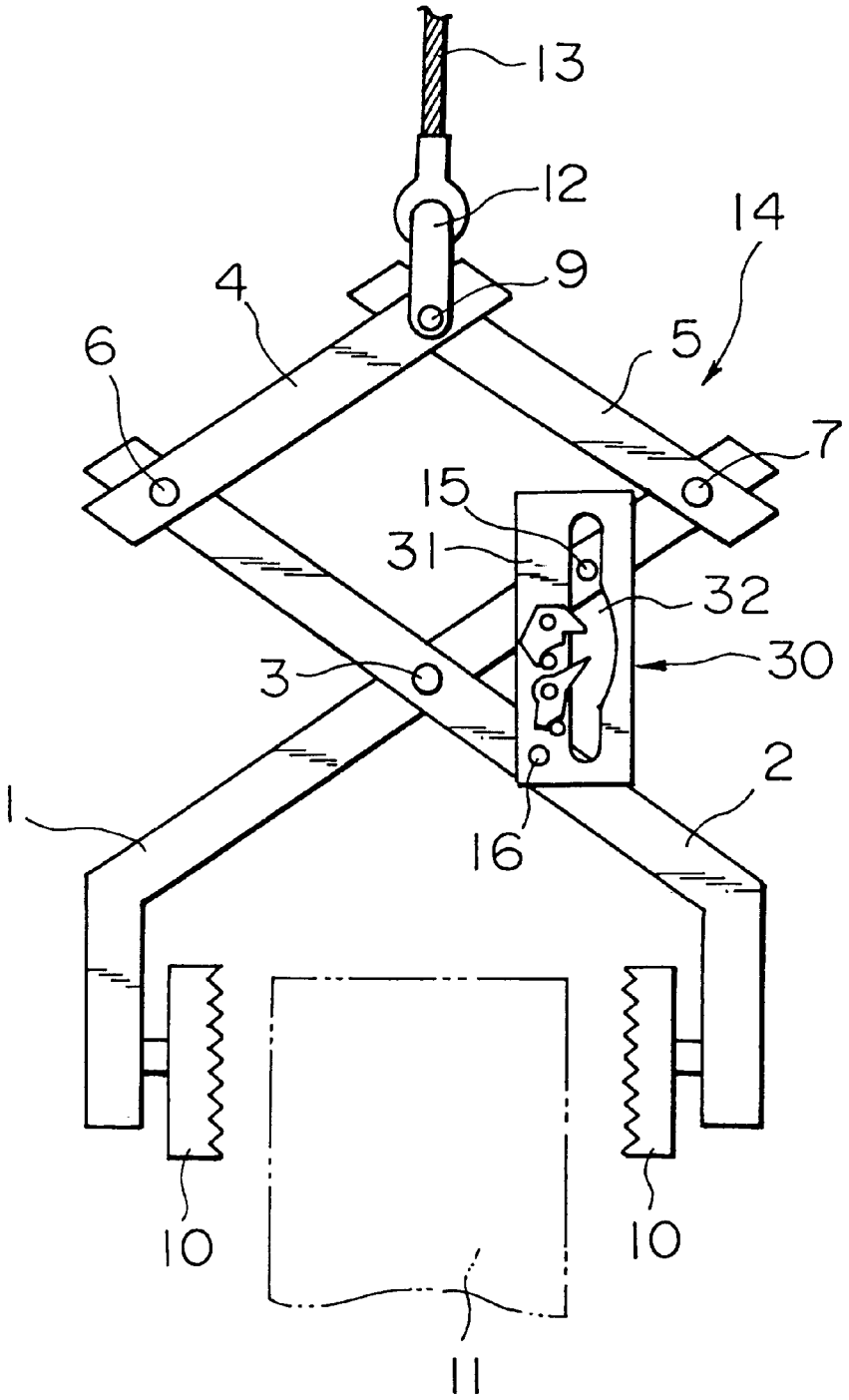
FIG. 3 is a diagram showing an example of a structure of a load lifting apparatus according to the present invention.

FIG. 3 is a diagram showing another structure of a load lifting apparatus according to the present invention. The load lifting apparatus differs from the load lifting apparatus shown in FIG. 1 in that the lock-unlock mechanism 30 is provided to extend between the clamping members 1 and 2 at a position closer to the right end of the link mechanism 14 than the pivot shaft 3, and the lower-left end portion of the frame 31 is rotatably attached to the clamping member 2 by the pin 16, and further that the projecting pin 15 provided on the clamping member 1 extends through the guide groove 32. In addition, the structure of the lock-unlock mechanism 30 slightly differs from that of the lock-unlock mechanism 20.

Figure 4:
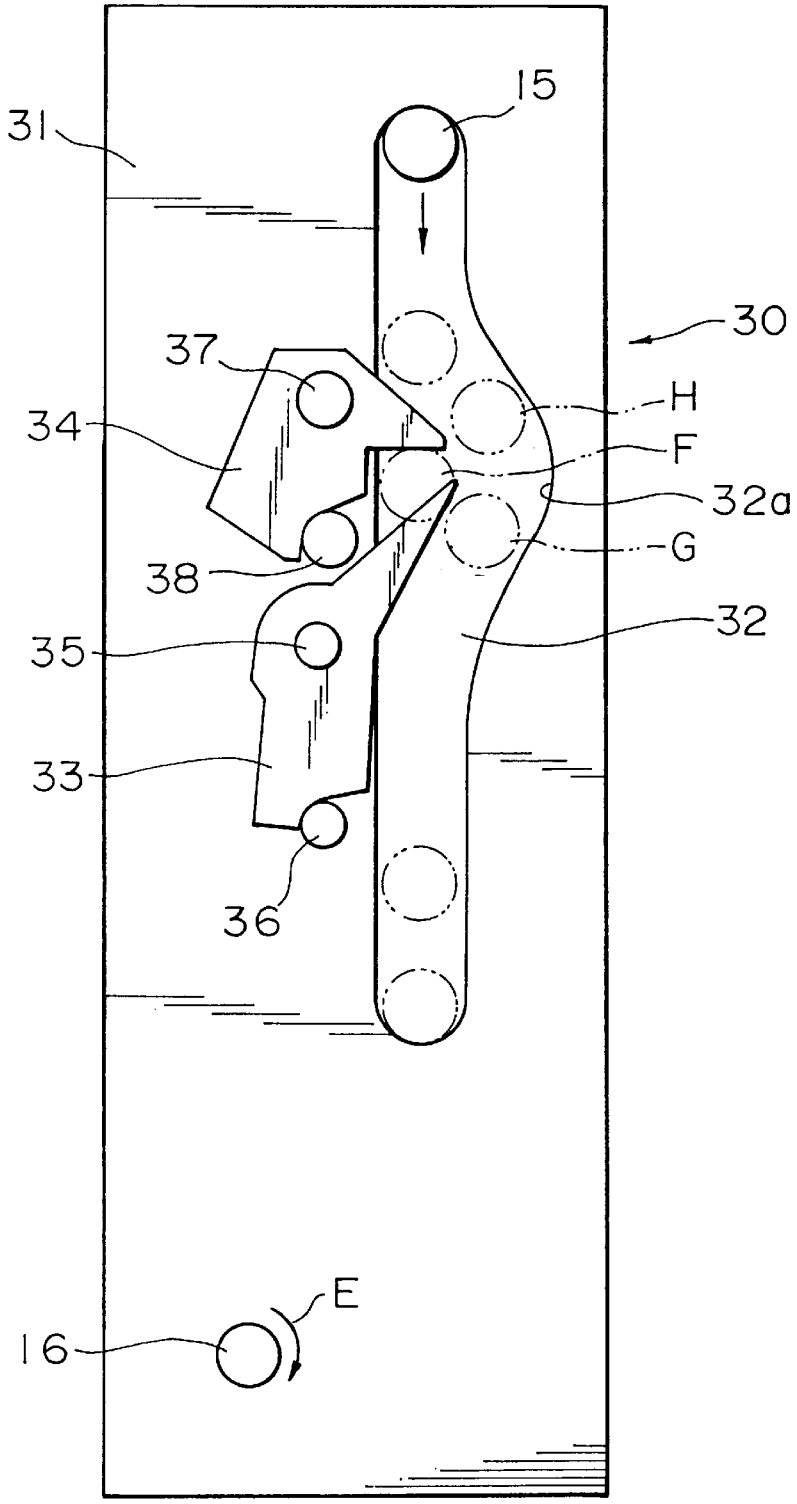
FIG. 4 is a diagram showing an example of a structure of a lock-unlock mechanism used in a load lifting apparatus according to the present invention.

FIG. 4 is a diagram showing the structure of the lock-unlock mechanism 30 in detail. The lock-unlock mechanism 30 has a plate-shaped frame 31 provided with a guide groove 32; a shunting member 33; and a latch 34. The lower-left end portion of the frame 31 is rotatably attached to the clamping member 2 by the pin 16. The guide groove 32 is pierced with the projecting pin 15 provided on the clamping member 1.

The shunting member 33 is rotatably attached to the frame 31 by a pin 35. The distal end of the shunting member 33 projects into the guide groove 32. Counterclockwise rotation of the shunting member 33 is limited by a stopper pin 36.

The latch 34 is rotatably attached to the frame 31 by a pin 37. The distal end of the latch 34 projects into the guide groove 32. Counterclockwise rotation of the latch 34 is limited at a predetermined position by a stopper pin 38.

A recessed portion 32*a* is formed in a side wall of the guide groove 32 at a position facing opposite to the distal ends of the latch 34 and the shunting member 33 as in the case of the lock-unlock mechanism 20.

The frame 31 is urged to rotate in the direction of the arrow E about the pin 16 by its own weight.

If the suspended ring 12 is lowered in the state shown in FIG. 3, the link mechanism 14 contracts vertically, causing the projecting pin 15 to move downward in the guide groove 32. When the projecting pin 15 comes in contact with the latch 34, the latch 34 rotates clockwise about the pin 37. After the projecting pin 15 passes the latch 34, the latch 34 rotates about the pin 37 by its own weight to return to a position where the latch 34 abuts on the stopper pin 38.

When the suspended ring 12 is raised in this state, the link mechanism 14 is caused to extend vertically, and the projecting pin 15 is also caused to move upward. However, the upward movement of the projecting pin 15 is blocked by the latch 34 (see F in FIG. 4).

Consequently, the clamping members 1 and 2 are stopped from rotating about the pivot shaft 3. Thus, the distance between the mutually opposing lower ends of the clamping members 1 and 2 is maintained (locked) in this state. At this time, the projecting pin 15 surely slides into a position where it abuts on the lower end of the latch 34 because the frame 31 is urged to rotate in the direction of the arrow E about the pin 16 by its own weight.

With the above state being maintained, the link mechanism 14 is moved to the position of the object 11, and the suspended ring 12 is lowered. Consequently, the projecting pin 15 moves downward in the guide groove 32. The projecting pin 15 pushes the shunting member 33 to rotate clockwise about the pin 35. After the projecting pin 15 has passed the shunting member 33, the shunting member 33 returns by its own weight until it comes in contact with the stopper pin 36.

When the suspended ring 12 is lifted in this state, the link mechanism 14 extends vertically, causing the projecting pin 15 to move upward through the space between the recessed portion 32*a* of the guide groove 32 and the distal ends of the shunting member 33 and the latch 34 (see G and H in FIG. 4). Consequently, the grab members 10 move toward each other to clamp the object 11.

After being clamped as described above, the object 11 is lifted and moved to a desired place. Then, the suspended ring 12 is lowered. Consequently, the projecting pin 15 moves downward in the guide groove 32 as in the case of the above, and at the same time, the distance between the grab members 10 enlarges. Thus, the object 11 is released.

When the suspended ring 12 is lifted after the projecting pin 15 has further moved downward past the latch 34, the projecting pin 15 is urged to move upward. However, the upward movement of the projecting pin 15 is prevented by the latch 34. Accordingly, the distance between the mutually opposing lower ends of the clamping members 1 and 2, that is, the distance between the grab members 10, is maintained (locked) at a value determined by the position of the projecting pin 15 (see F in FIG. 4). At this time, the projecting pin 15 surely slides into a position where it abuts on the lower end of the latch 34 because the frame 31 is urged to rotate in the direction of the arrow E about the pin 16 by its own weight as in the case of the above.

Figure 5:
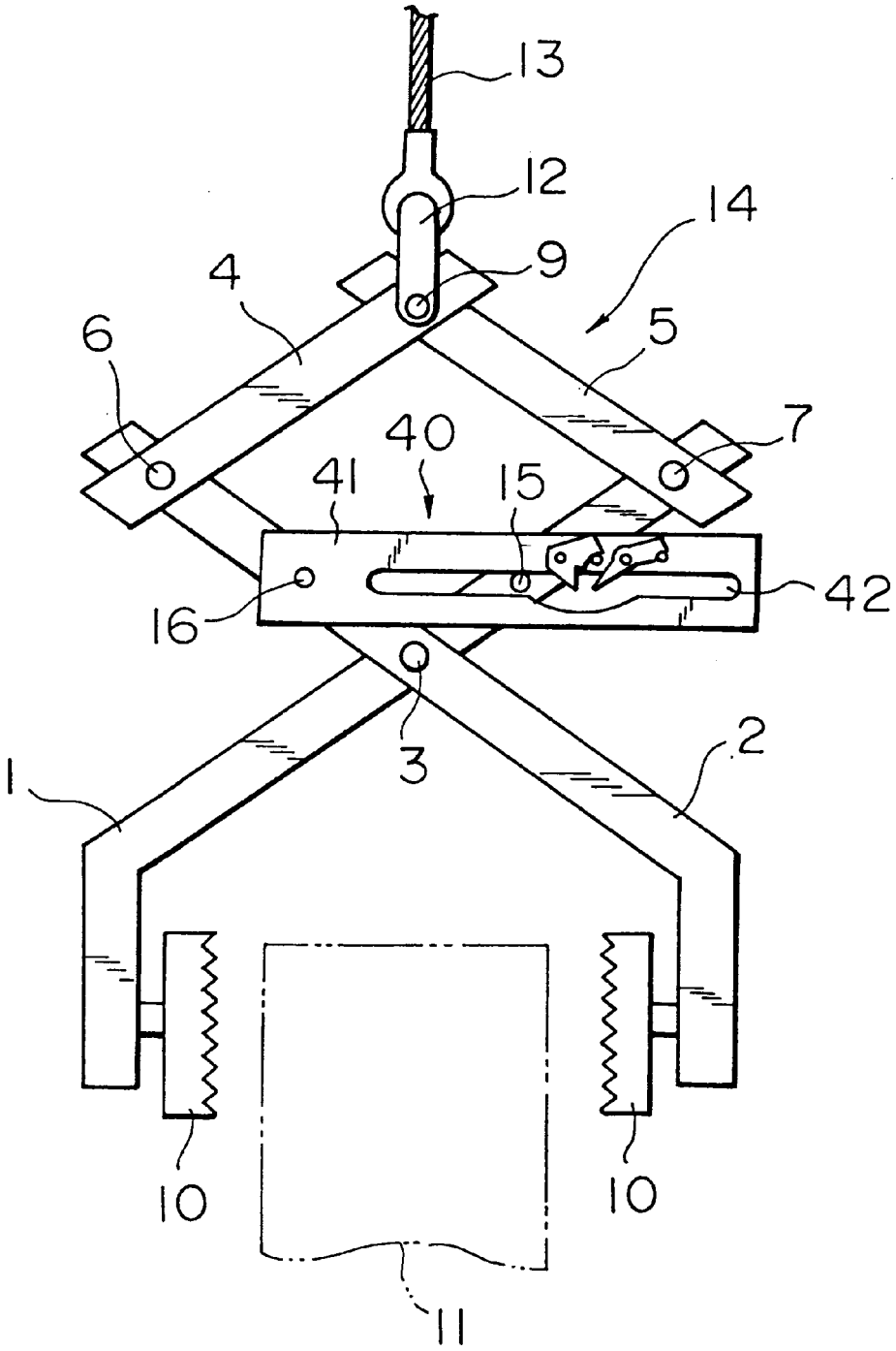
FIG. 5 is a diagram showing an example of a structure of a load lifting apparatus according to the present invention.

FIG. 5 is a diagram showing another structure of a load lifting apparatus according to the present invention. The load lifting apparatus differs from the load lifting apparatus shown in FIG. 3 in that the lock-unlock mechanism 40 is provided to extend horizontally above the pivot shaft 3 of the link mechanism 14, and the left end portion of the frame 41 is rotatably attached to the clamping member 2 by the pin 16, and further that the projecting pin 15 provided on the clamping member 1 extends through the guide groove 42.

Figure 6:
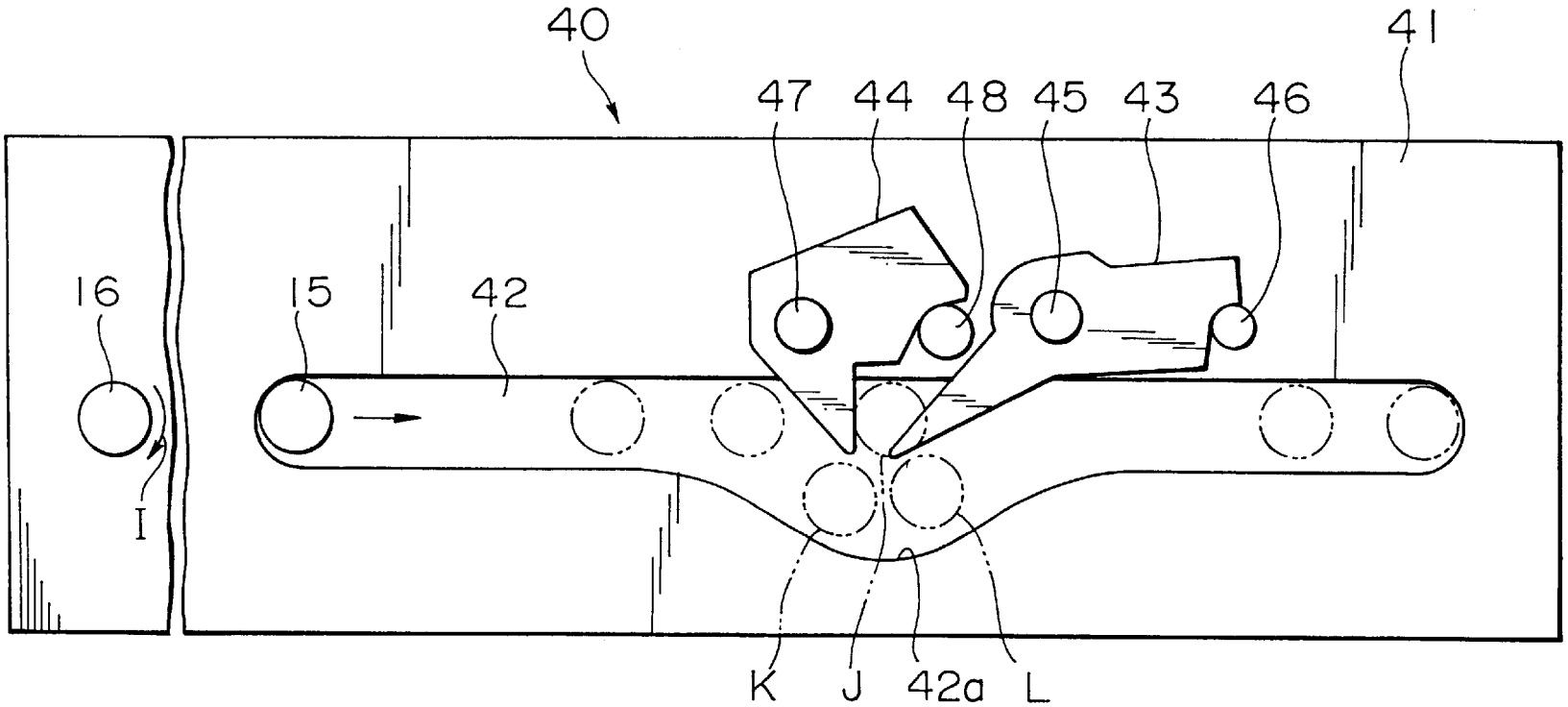
FIG. 6 is a diagram showing an example of a structure of a lock-unlock mechanism used in a load lifting apparatus according to the present invention.

FIG. 6 is a diagram showing the structure of the lock-unlock mechanism 40 in detail. The lock-unlock mechanism 40 has a plate-shaped frame 41 provided with a guide groove 42; a shunting member 43; and a latch 44.

The left end portion of the frame 41 is rotatably attached to the clamping member 2 by the pin 16. The guide groove 42 is pierced with the projecting pin 15 provided on the clamping member 1. The shunting member 43 is rotatably attached to the frame 41 by a pin 45. The distal end of the shunting member 43 projects into the guide groove 42. Clockwise rotation of the shunting member 43 is limited by a stopper pin 46.

The latch 44 is rotatably attached to the frame 41 by a pin 47. The distal end of the latch 44 projects into the guide groove 42. Clockwise rotation of the latch 44 is limited by a stopper pin 48.

A recessed portion 42*a* is formed in a side wall of the guide groove 42 at a position facing opposite to the distal ends of the shunting member 43 and the latch 44 as in the case of the lock-unlock mechanisms 20 and 30.

The frame 41 is urged to rotate in the direction of the arrow I about the pin 16 by its own weight.

If the suspended ring 12 is lowered in the state shown in FIG. 5, the link mechanism 14 contracts vertically, causing the projecting pin 15 to move rightward in the guide groove 42.

When the projecting pin 15 comes in contact with the latch 44, the latch 44 rotates counterclockwise about the pin 47. After the projecting pin 15 passes the latch 44, the latch 44 rotates about the pin 47 by its own weight to return to a position where the latch 44 abuts on the stopper pin 48.

When the suspended ring 12 is raised in this state, the link mechanism 14 is caused to extend vertically, and the projecting pin 15 is caused to move leftward. However, the leftward movement of the projecting pin 15 is blocked by the latch 44 (see J in FIG. 6).

Consequently, the clamping members 1 and 2 are stopped from rotating about the pivot shaft 3. Thus, the distance between the mutually opposing lower ends of the clamping members 1 and 2 is maintained (locked) in this state.

At this time, the projecting pin 15 surely slides into a position where it abuts on the right edge of the latch 44 because the frame 41 is urged to rotate in the direction of the arrow I about the pin 16 by its own weight.

With the above state being maintained, the link mechanism 14 is moved to the position of the object 11, and the suspended ring 12 is lowered such that the object 11 lies between the clamping members 1 and 2 of the link mechanism 14. Consequently, The projecting pin 15 pushes the shunting member 43 to rotate counterclockwise about the pin 45.

When the suspended ring 12 is lifted in this state, the link mechanism 14 extends vertically, causing the projecting pin 15 to move leftward through the space between the recessed portion 42*a* of the guide groove 42 and the distal ends of the shunting member 43 and the latch 44 (see K and L in FIG. 6). Consequently, the grab members 10 move toward each other to clamp the object 11.

After being clamped as described above, the object 11 is lifted and moved to a desired place. Then, the suspended ring 12 is lowered. Consequently, the projecting pin 15 moves rightward in the guide groove 42 as in the case of the above, and at the same time, the distance between the grab members 10 enlarges. Thus, the object 11 is released.

When the suspended ring 12 is lifted after the if projecting pin 15 has further moved rightward past the latch 44, leftward movement of the projecting pin 15 is blocked by the latch 44. Accordingly, the distance between the mutually opposing lower ends of the clamping members 1 and 2, that is, the distance between the grab members 10, is maintained at a value determined by the position of the projecting pin 15 (see J in FIG. 6).

At this time, the projecting pin 15 surely slides into a position where it abuts on the right edge of the latch 44 because the frame 41 is urged to rotate in the direction of the arrow I about the pin 16 by its own weight as in the case of the above.

As stated above, the load clamping and lifting apparatus according to the present invention has a four-point link mechanism 14 comprising the clamping member 1, the clamping member 2, the link member 4 and the link member 5, and the link mechanism 14 is provided with the lock-unlock mechanism 20 (30 or 40), thereby enabling the object 11 to be clamped, lifted and moved to a desired place and released simply by raising and lowering the suspended ring 12 by a crane or the like through the wire rope 13. Thus, it is possible to dispense with an operation of winding a wire rope around the object 11 for each materials-handling operation, which is difficult and may be dangerous according to the conditions of the place where the materials-handling operation is carried out.

Figure 7:
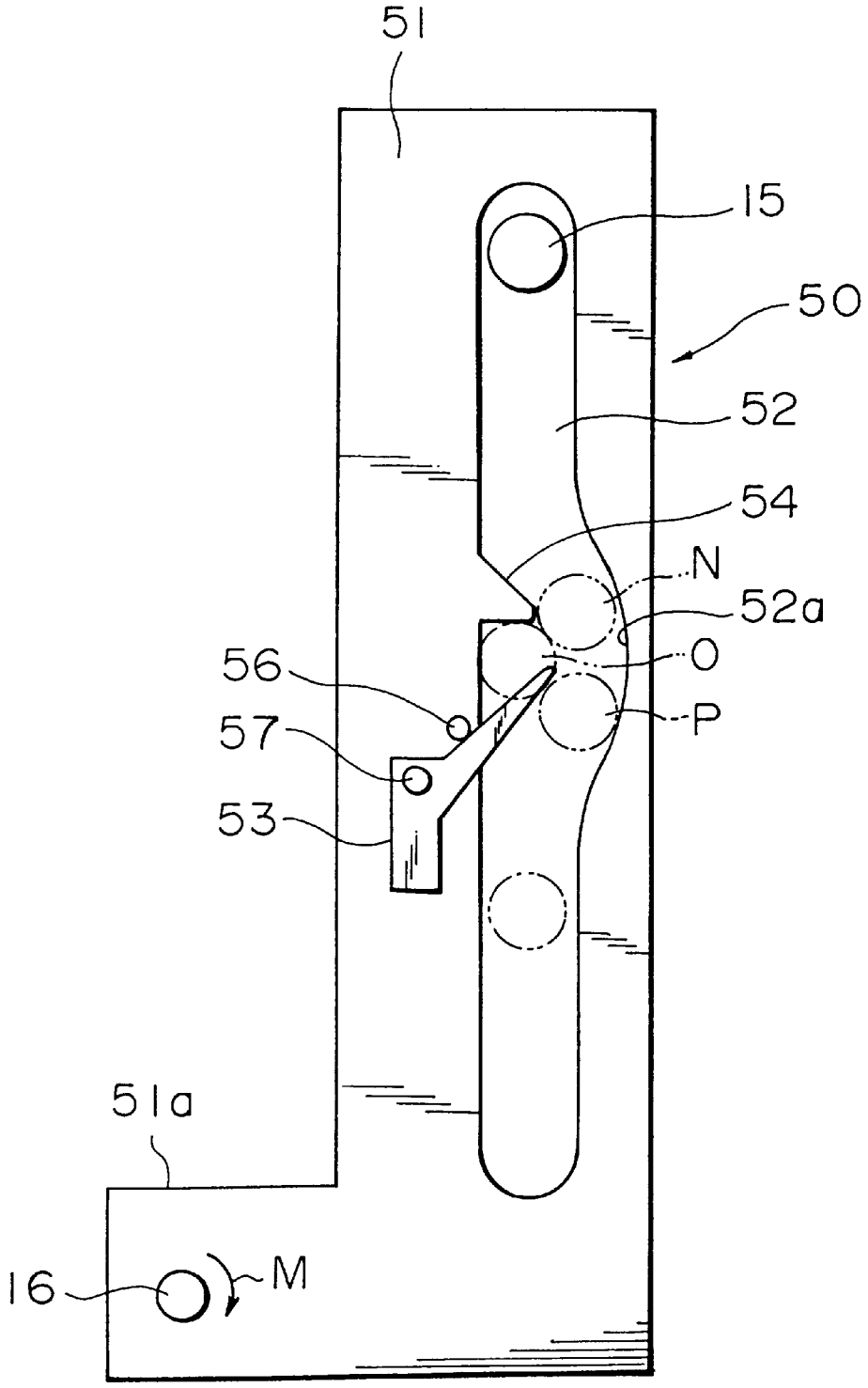
FIG. 7 is a diagram showing an example of a structure of a lock-unlock mechanism used in a load lifting apparatus according to the present invention.

FIG. 7 is a diagram showing another example of the structure of a lock-unlock mechanism used in the load clamping and lifting apparatus according to the present invention. The lock-unlock mechanism 50 has a structure in which a latch projection 54 is provided to project into the guide groove 52 in place of the latch 34 having the structure shown in FIG. 4.

In addition, the frame 51 has a projection 51*a* extending leftwardly from the lower end thereof. The lock-unlock mechanism 50 having such a structure is mounted on the link mechanism 14 in place of the lock-unlock mechanism 30 shown in FIG. 3. More specifically, the projection 51*a* is rotatably attached to the clamping member 2 by the pin 16, and the guide groove 52 is pierced with the projecting pin 15 provided on the clamping member 1.

In this state, the frame 51 is urged to rotate in the direction of the arrow M about the pin 16 by its own weight.

With the lock-unlock mechanism 50 having the above-described structure, when the suspended ring 12 is lowered, the link mechanism 14 contracts vertically, causing the projecting pin 15 to move downward in the guide groove 52.

During the downward movement, the projecting pin 15 first comes in contact with the latch projection 54 and then passes through the space between the distal end of the latch projection 54 and the recessed portion 52*a* of the guide groove 52 (see N in FIG. 7). Because the frame 51 is urged to rotate in the direction of the arrow M about the pin 16 as stated above, the projecting pin 15 enters the space between the latch projection 54 and the shunting member 53 (see O in FIG. 7) after passing through the space between the distal end of the latch projection 54 and the recessed portion 52*a* of the guide groove 52.

When the suspended ring 12 is raised in this state, the link mechanism 14 is caused to extend vertically, and the projecting pin 15 is also caused to move upward. However, the upward movement of the projecting pin 15 is blocked by the latch projection 54. Consequently, the clamping members 1 and 2 are stopped from rotating about the pivot shaft 3. Thus, the distance between the mutually opposing lower ends of the clamping members 1 and 2 is maintained (locked) in this state.

With the above state being maintained, the link mechanism 14 is moved to the position of the object 11, and then the suspended ring 12 is lowered. Consequently, the projecting pin 15 also moves downward and pushes the shunting member 53 to rotate clockwise about a pin 57. After the projecting pin 15 has passed the shunting member 53, the shunting member 53 returns by its own weight until it comes in contact with the stopper pin 56.

When the suspended ring 12 is lifted in this state, the link mechanism 14 extends vertically, causing the projecting pin 15 to move upward through the space between the distal end of the shunting member 53 and the recessed portion 52*a* of the guide groove 52 and through the space between the distal end of the latch projection 54 and the recessed portion 52*a* (see P and N in FIG. 7).

Consequently, the grab members 10 move toward each other to clamp the object 11.

After being clamped as described above, the object 11 is lifted and moved to a desired place. Then, the suspended ring 12 is lowered. Consequently, the projecting pin 15 moves downward in the guide groove 32 as in the case of the above, and at the same time, the distance between the grab members 10 enlarges. Thus, the object 11 is released.

When the suspended ring 12 is lifted after the projecting pin 15 has further moved downward past the latch projection 54, the projecting pin 15 is prevented from moving upward by the latch projection 54. Accordingly, the distance between the mutually opposing lower ends of the clamping members 1 and 2, that is, the distance between the grab members 10, is maintained at a value determined by the position of the projecting pin 15 (see 0 in FIG. 7).

At this time, the projecting pin 15 surely slides into a position where it abuts on the lower end of the latch projection 54 because the frame 51 is urged to rotate in the direction of the arrow M about the pin 16 as in the case of the above.

Figure 8:
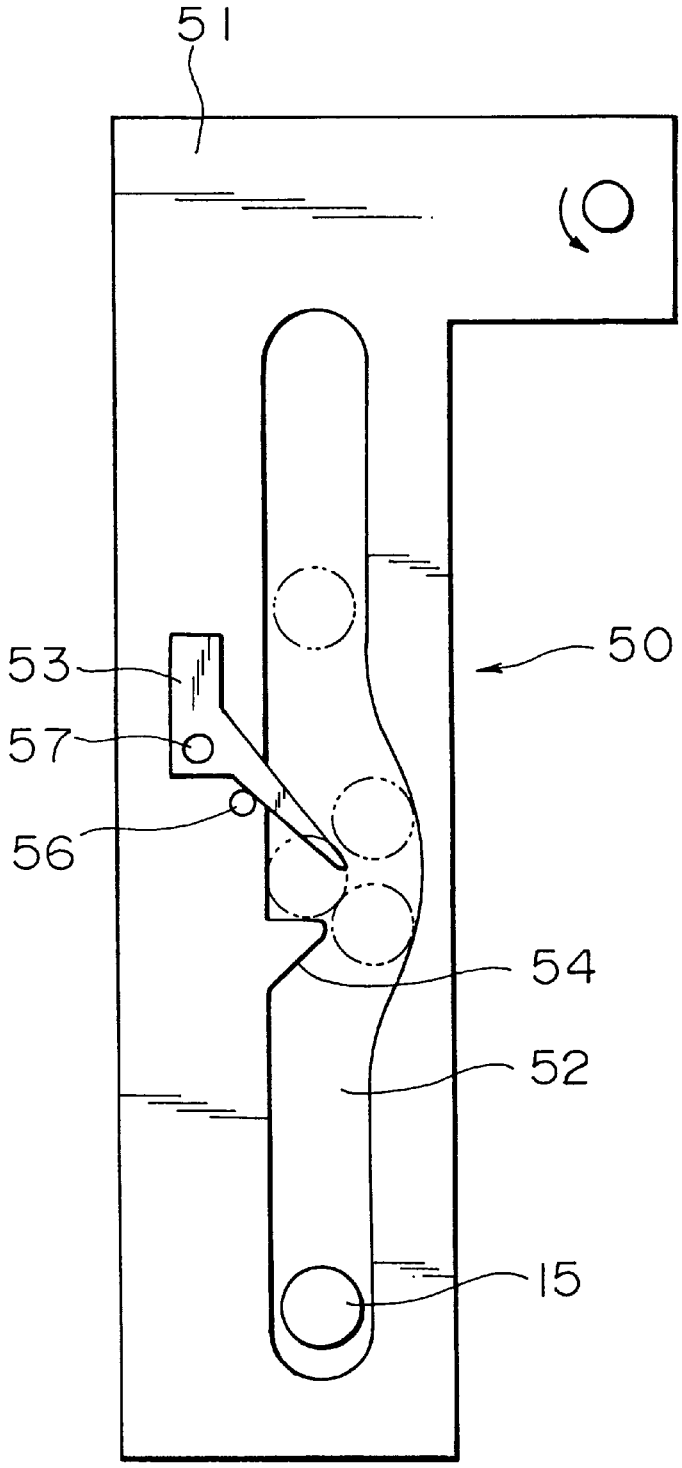
FIG. 8 is a diagram showing an example of a structure of a lock-unlock mechanism used in a load lifting apparatus according to the present invention.

FIG. 8 is a diagram showing another example of the structure of a lock-unlock mechanism used in the load clamping and lifting apparatus according to the present invention. The lock-unlock mechanism 50 is approximately the same as the lock-unlock mechanism 50 shown in FIG. 7. The lock-unlock mechanism shown in FIG. 7 and that shown in FIG. 8 are in an upside-down relation to each other.

The lock-unlock mechanism 50 is used in place of the lock-unlock mechanism of the load lifting apparatus shown in FIG. 1. The operation of the lock-unlock mechanism 50 is approximately the same as that of the l6ck-unlock mechanism 50 shown in FIG. 7; therefore, a description thereof is omitted.

Figure 9:
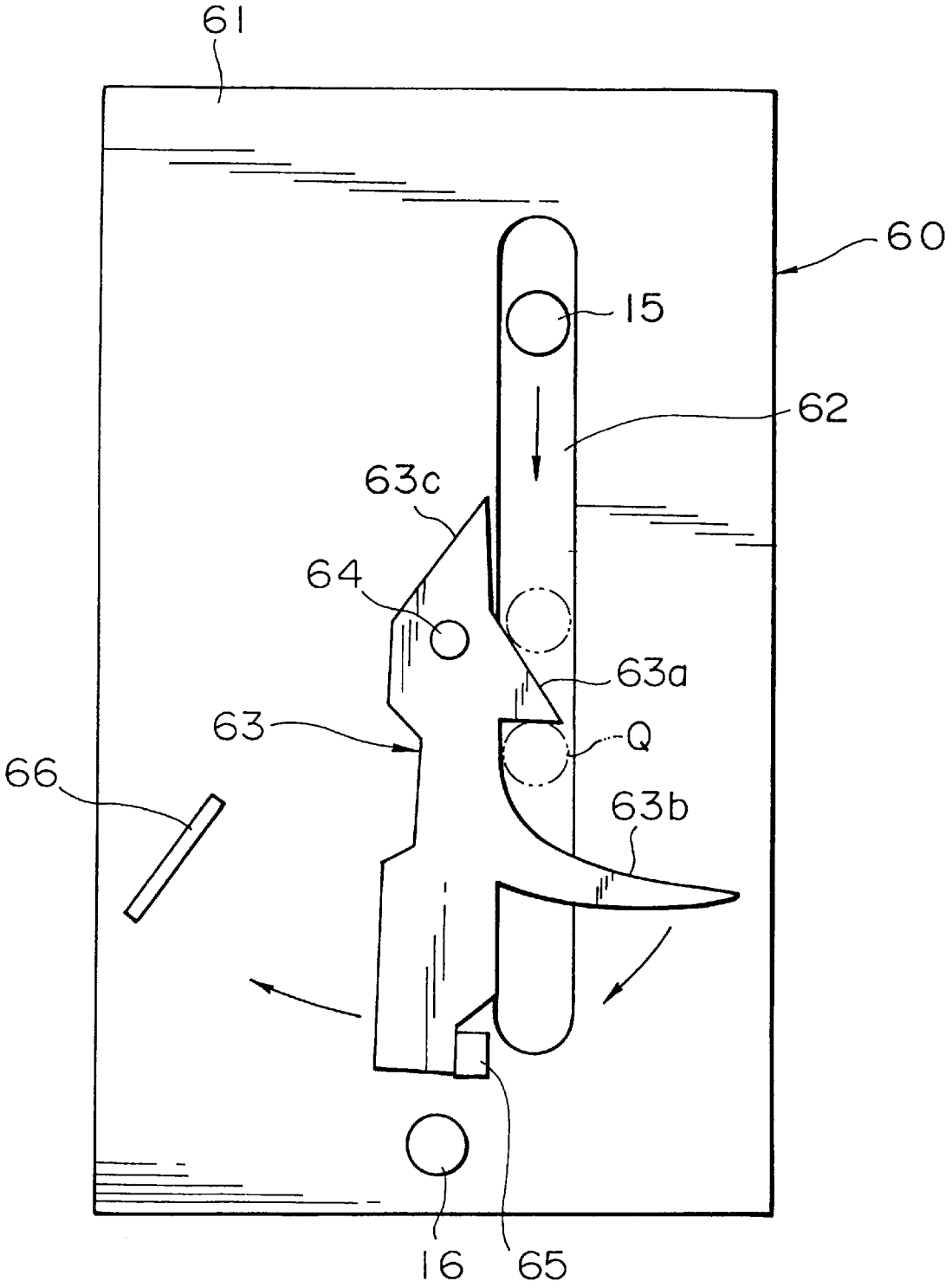
FIG. 9 is a diagram showing an example of a structure of a lock-unlock mechanism used in a load lifting apparatus according to the present invention.

FIG. 9 is a diagram showing another example of the structure of a lock-unlock mechanism used in the load clamping and lifting apparatus according to the present invention. The lock-unlock mechanism 60 has a structure in which a frame 61 having a straight-line shaped guide groove 62 is provided with a latch member 63 that rotates about a pin 64.

The latch member 63 is provided with a latch projection 63*a* such that the latch projection 63*a* projects into the guide groove 62. The latch member 63 is further provided with a projection 63*b* for rotation such that the projection 63*b* extends across the guide groove 62. Further, the latch member 63 is provided with a projection 63*c* for release above the latch projection 63*a*.

Counterclockwise rotation of the latch member 63 is limited by a stopper 65.

It should be noted that reference numeral 66 denotes a magnet for holding the latch member 63 in a predetermined rotational position.

The lock-unlock mechanism 60 having the above-described structure is mounted on the link mechanism 14 in place of the lock-unlock mechanism 30 shown in FIG. 3. More specifically, the frame 61 is secured to the clamping member 2 by the pin 16 (the frame 61 is not completely fixed but slightly loosely secured), and the guide groove 62 is pierced with the projecting pin 15 provided on the clamping member 1.

If the suspended ring 12 is lowered in the state shown in FIG. 3, the projecting pin 15 also moves downward. When the projecting pin 15 comes in contact with the latch projection 63*a*, the latch member 63 rotates clockwise about the pin 64.

After the projecting pin 15 has passed the distal end of the latch projection 63*a*, the latch member 63 rotates counterclockwise about the pin 64 by its own weight to return to a position where the latch member 63 abuts on the stopper 65.

When the suspended ring 12 is raised in this state, the link mechanism 14 is caused to extend vertically, and the projecting pin 15 is also caused to move upward. However, the upward movement of the projecting pin 15 is blocked by the latch projection 63*a* (see Q in FIG. 9).

Consequently, the clamping members 1 and 2 are stopped from rotating about the pivot shaft 3. Thus, the distance between the mutually opposing lower ends of the clamping members 1 and 2 is maintained (locked) in this state.

Figure 10:
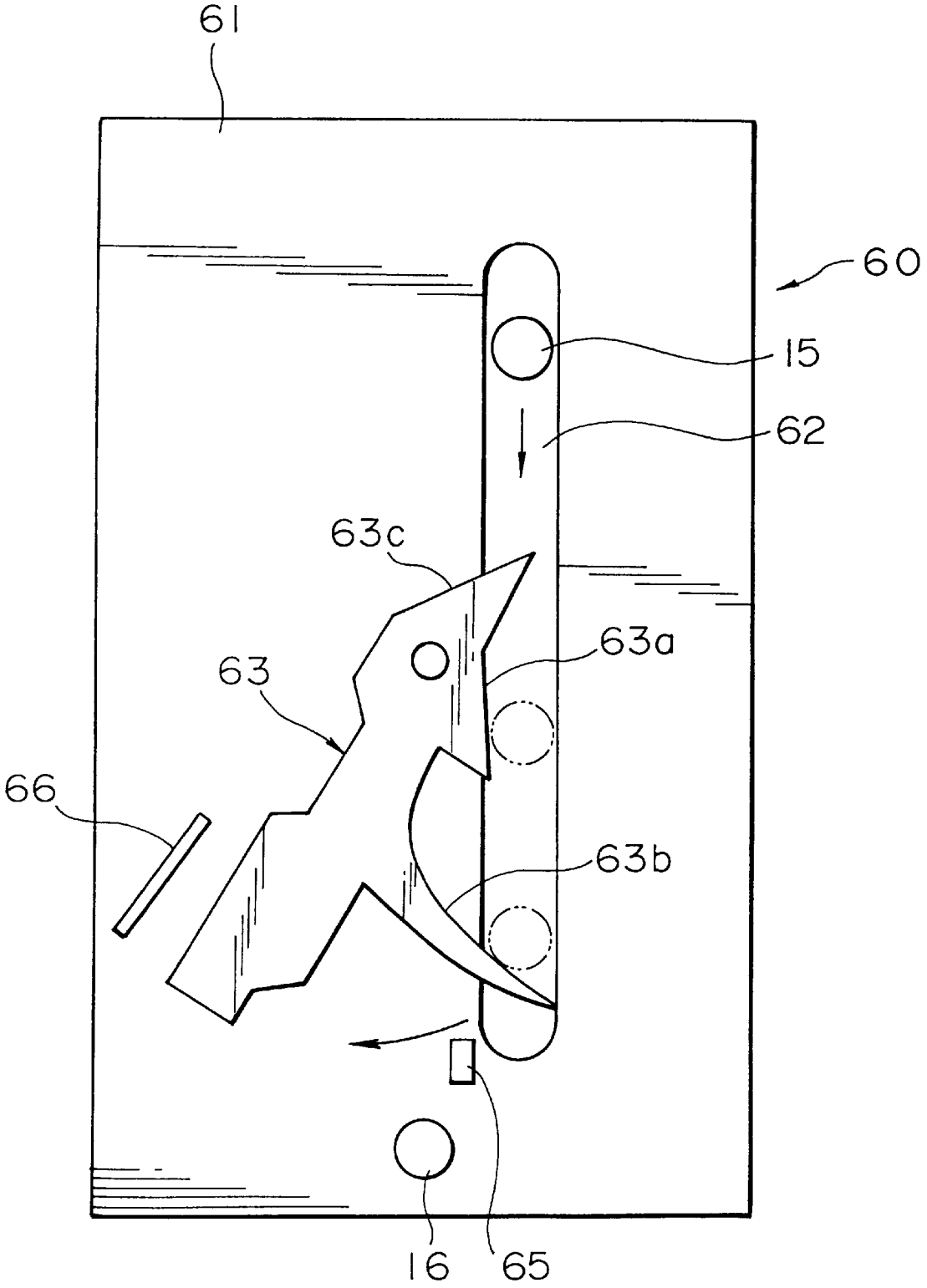
FIG. 10 is a diagram showing an example of a structure of a lock-unlock mechanism used in a load lifting apparatus according to the present invention.

With the above state being maintained, the link mechanism 14 is moved to the position of the object 11, and the suspended ring 12 is lowered. Consequently, the projecting pin 15 moves downward and pushes the projection 63*b* for rotation, causing the latch member 63 to rotate clockwise about the pin 64 as shown in FIG. 10.

Figure 11:
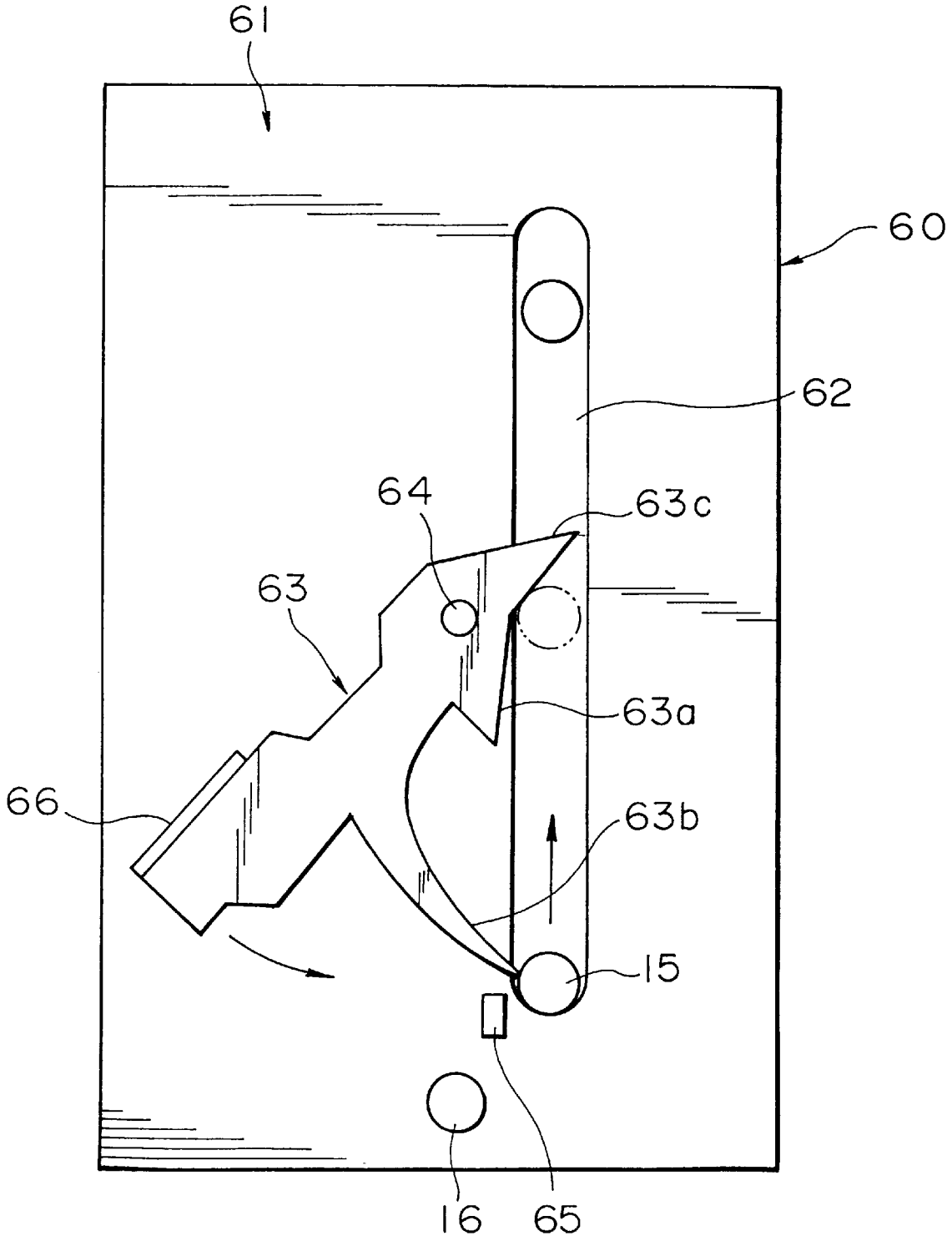
FIG. 11 is a diagram showing an example of a structure of a lock-unlock mechanism used in a load lifting apparatus according to the present invention.

When the projecting pin 15 further moves downward to reach the distal end of the projection 63*b* as shown in FIG. 11, the latch member 63 is held by the magnet 66. Thus, the latch member 63 is maintained in this position, and the distance between the mutually opposing lower ends of the clamping members 1 and 2 of the link mechanism 14 reaches a maximum.

When the suspended ring 12 is raised in this state, the projecting pin 15 moves upward in the guide groove 62 past the latch projection 63*a* and comes in contact with the projection 63*c* for release. Consequently, the latch member 63 rotates counterclockwise about the pin 64.

Thus, the latch member 63 is released from the magnet 66, and the latch member 63 rotates about the pin 64 to return to the position shown in FIG. 9 by its own weight.

As the projecting pin 15 further moves upward, the grab members 10 move toward each other to clamp the object 11.

After being clamped as described above, the object 11 is lifted and moved to a desired place. Then, the suspended ring 12 is lowered. Consequently, the projecting pin 15 moves downward in the guide groove 32 as in the case of the above, and at the same time, the distance between the grab members 10 enlarges. Thus, the object 11 is released.

When the projecting pin 15 further moves downward past the distal end of the latch projection 63*a*, the latch member 63 rotates about the pin 64 to return to the position shown in FIG. 9 by its own weight. Thus, if the suspended ring 12 is raised in this state, the clamping members 1 and 2 are locked in the respective positions.

Figure 12:
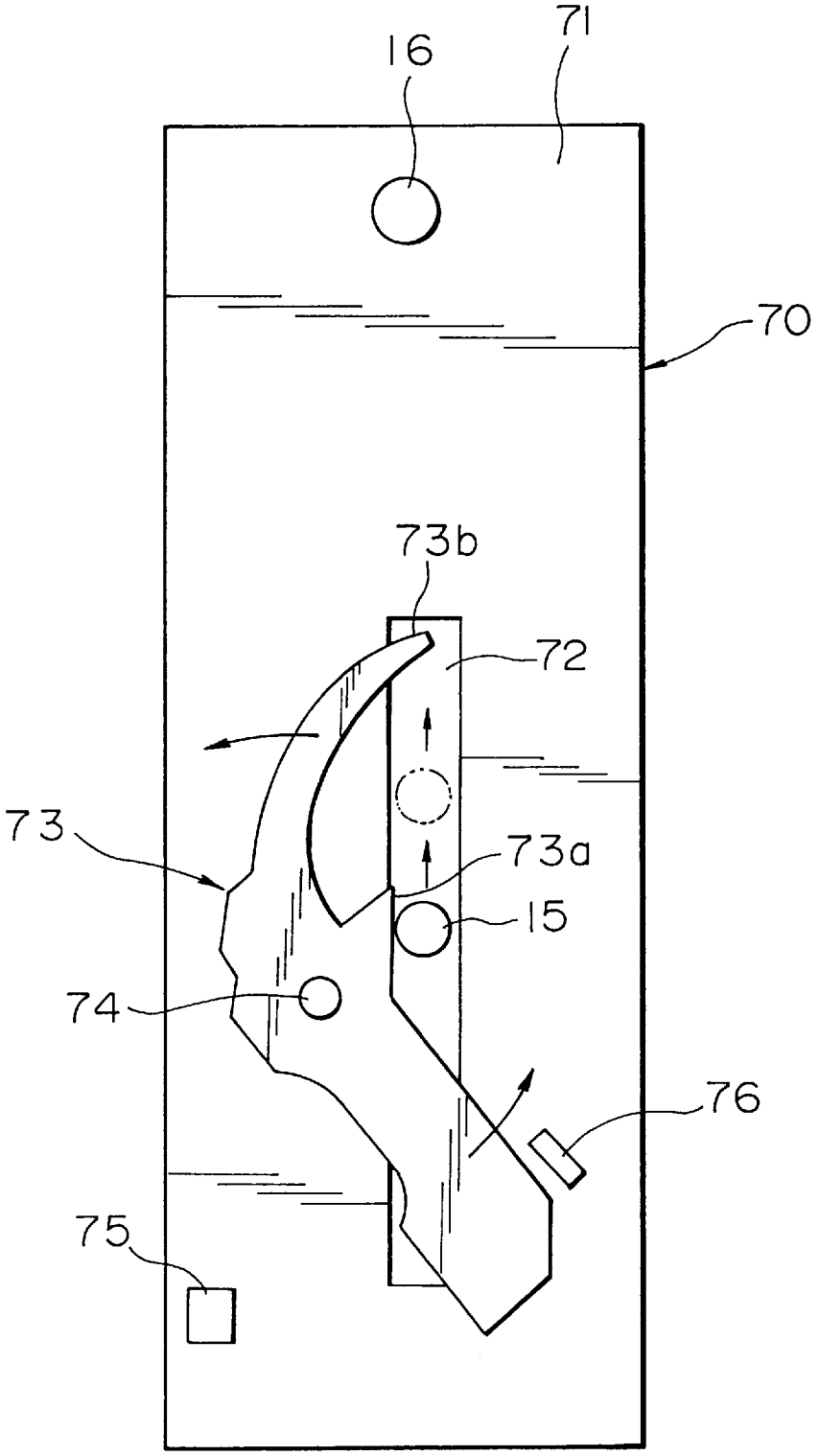
FIG. 12 is a diagram showing an example of a structure of a lock-unlock mechanism used in a load lifting apparatus according to the present invention.

FIG. 12 is a diagram showing another example of the structure of a lock-unlock mechanism used in the load clamping and lifting apparatus according to the present invention. The lock-unlock mechanism 70 has a structure in which a frame 71 having a straight-line shaped guide groove 72 is provided with a latch member 73 that rotates about a pin 74.

Figure 13:
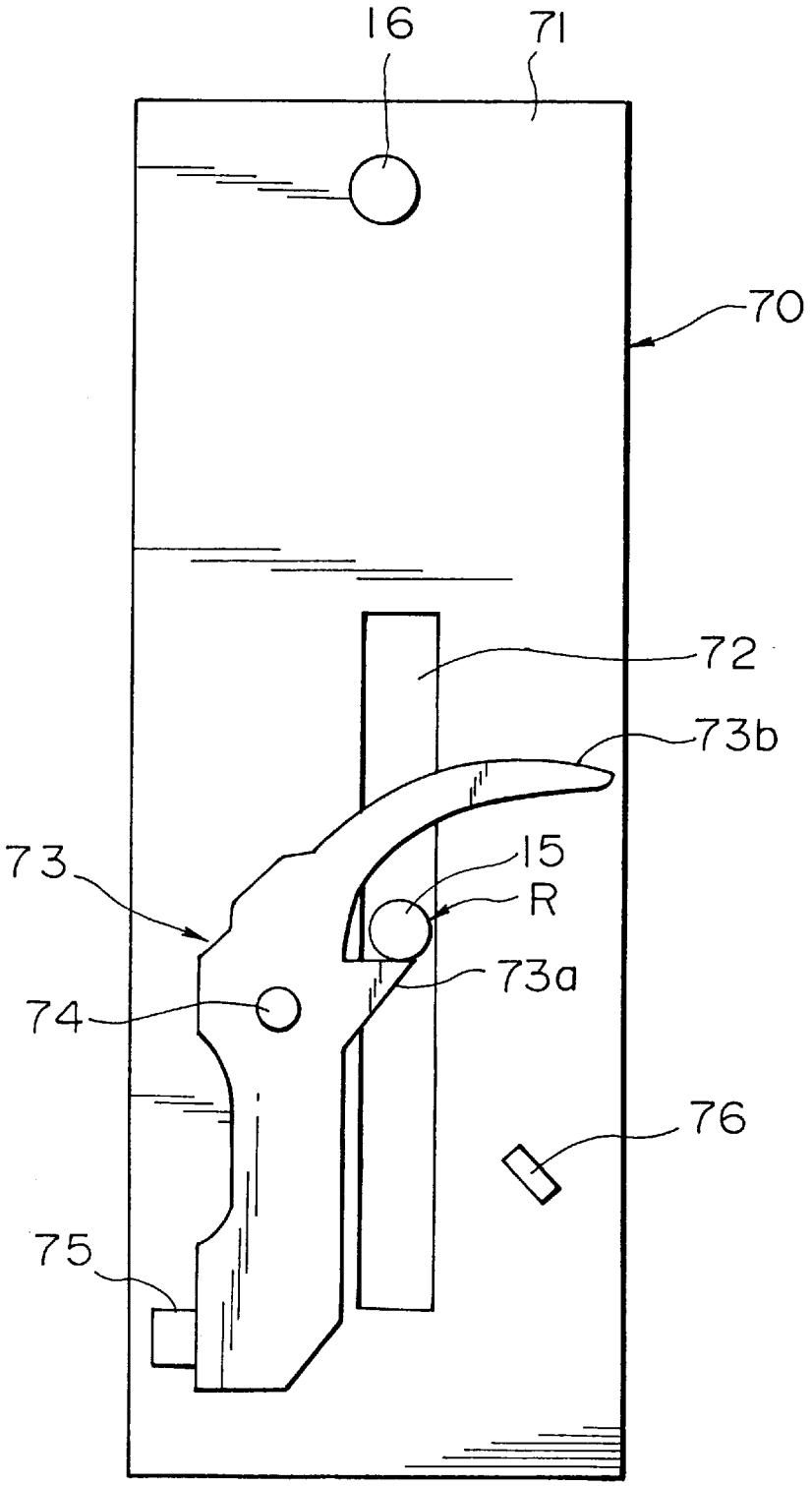
FIG. 13 is a diagram showing an example of a structure of a lock-unlock mechanism used in a load lifting apparatus according to the present invention.

As shown in FIG. 13, the latch member 73 is provided with a latch projection 73*a* such that the latch projection 73*a* projects into the guide groove 72. The latch member 73 is further provided with a projection 73*b* for rotation such that the projection 73*b* extends across the guide groove 72.

Counterclockwise rotation of the latch member 73 is limited by a stopper 75.

It should be noted that reference numeral 76 denotes a magnet for holding the latch member 73 in a predetermined rotational position.

The lock-unlock mechanism 70 having the above-described structure is mounted on the link mechanism 14 in place of the lock-unlock mechanism 20 shown in FIG. 1. More specifically, the frame 71 is secured to the clamping member 2 by the pin 16 (the frame 71 is not completely fixed but slightly loosely secured), and the guide groove 72 is pierced with the projecting pin 15 provided on the clamping member 1.

If the suspended ring 12 is lowered in the state shown in FIG. 12, the projecting pin 15 moves upward. When the projecting pin 15 comes in contact with the latch projection 73*a*, the latch member 73 rotates counterclockwise about the pin 74.

After the projecting pin 15 has passed the distal end of the latch projection 73*a*, the latch member 73 rotates clockwise about the pin 74 by its own weight to return to a position where the latch member 73 abuts on the stopper 75 as shown in FIG. 13.

When the suspended ring 12 is raised in this state, the link mechanism 14 is caused to extend vertically, and the projecting pin 15 is caused to move downward. However, the downward movement of the projecting pin 15 is blocked by the latch projection 73*a* (see R in FIG. 13).

Consequently, the clamping members 1 and 2 are stopped from rotating about the pivot shaft 3. Thus, the distance between the mutually opposing lower ends of the clamping members 1 and 2 is maintained (locked) in this state.

With the above state being maintained, the link mechanism 14 is moved to the position of the object 11, and the suspended ring 12 is lowered. Consequently, the projecting pin 15 moves upward and pushes the projection 73*b* for rotation, causing the latch member 73 to rotate counterclockwise about the pin 74.

Figure 14:
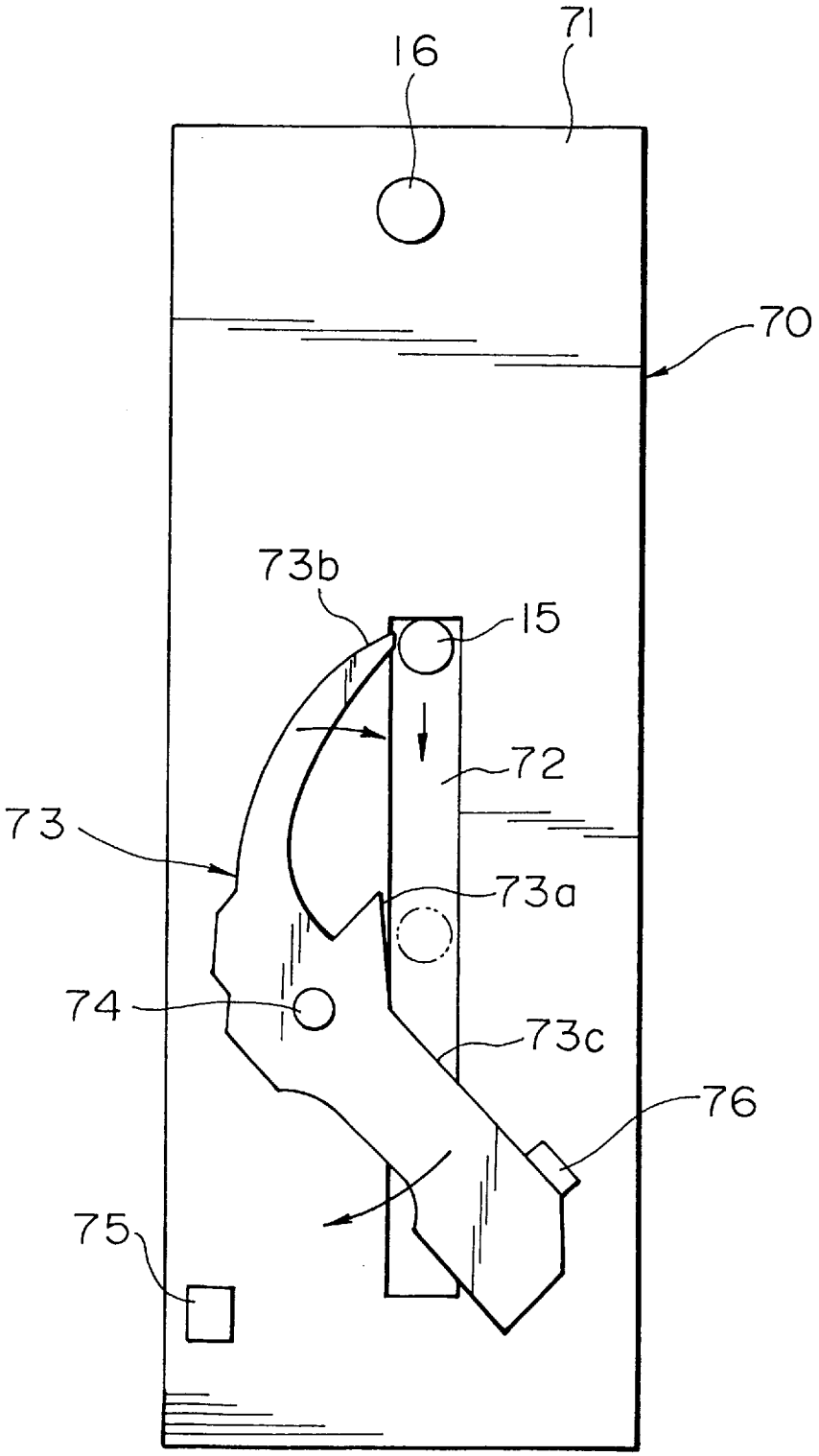
FIG. 14 is a diagram showing an example of a structure of a lock-unlock mechanism used in a load lifting apparatus according to the present invention.

When the projecting pin 15 further moves upward to reach the distal end of the projection 73*b* as shown in FIG. 14, the latch member 73 is held by the magnet 76. Thus, the latch member 73 is maintained in the rotational position, and the distance between the mutually opposing lower ends of the clamping members 1 and 2 of the link mechanism 14 reaches a maximum.

When the suspended ring 12 is raised in this state, the projecting pin 15 moves downward in the guide groove 72 past the latch projection 73*a* and comes in contact with a side portion 73*c* of the latch member 73. Consequently, the latch member 73 rotates clockwise about the pin 74.

Thus, the latch member 73 is released from the magnet 76, and the latch member 73 rotates about the pin 74 by its own weight. Consequently, the grab members 10 move toward each other to clamp the object 11.

After being clamped as described above, the object 11 is lifted and moved to a desired place. Then, the suspended ring 12 is lowered. Consequently, the projecting pin 15 moves upward in the guide groove 32 as in the case of the above, and at the same time, the distance between the grab members 10 enlarges. Thus, the object 11 is released.

When the projecting pin 15 further moves upward past the distal end of the latch projection 73*a*, the latch member 73 rotates about the pin 74 to return to the position shown in FIG. 13 by its own weight as in the case of the above. Thus, if the suspended ring 12 is raised in this state, the clamping members 1 and 2 are locked in the respective positions.

Figure 15:
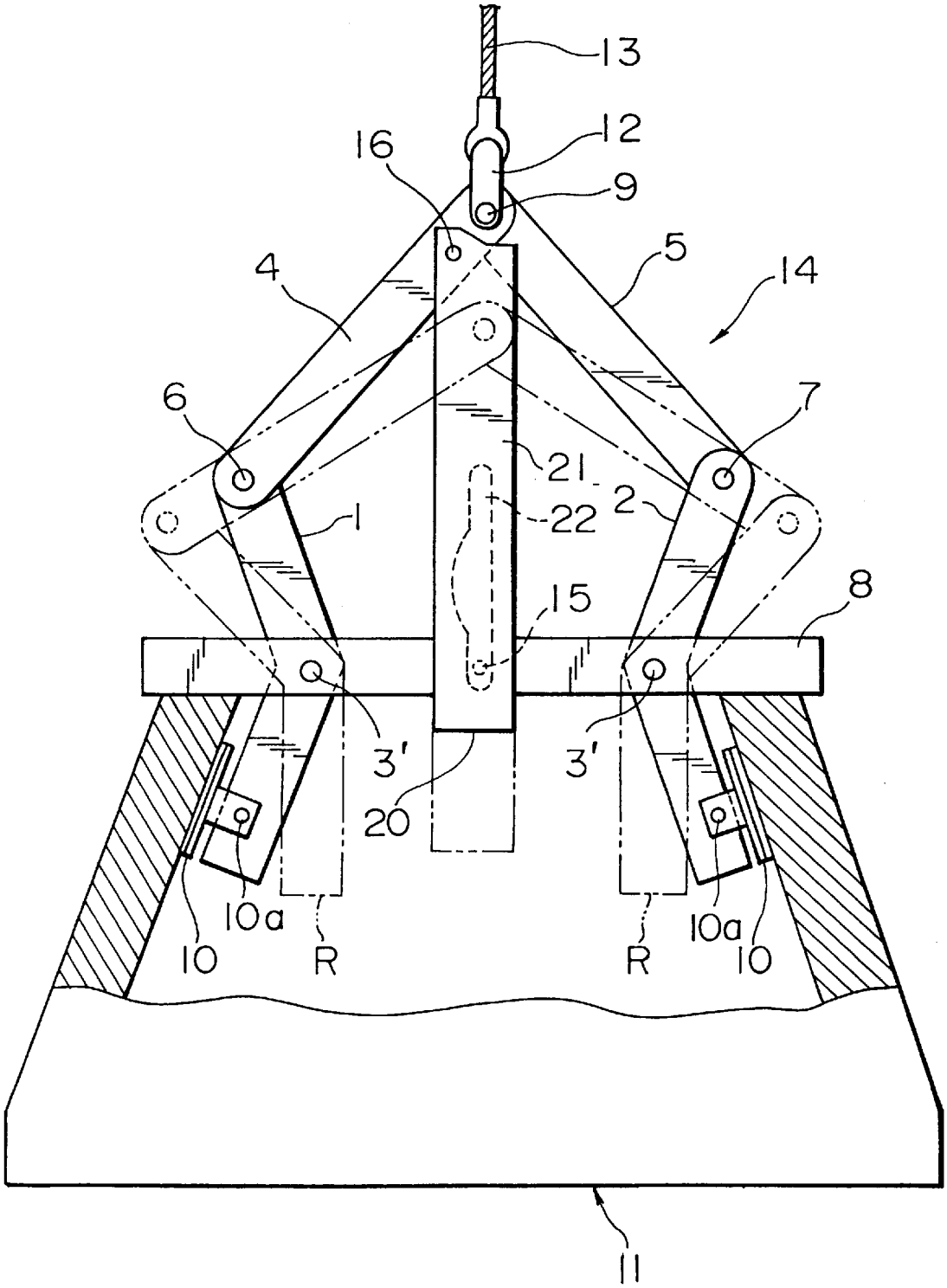
FIG. 15 is a diagram showing an example of a structure of a load lifting apparatus according to the present invention.

FIG. 15 is a diagram showing another structure of a load lifting apparatus according to the present invention. This load lifting apparatus is used to lift a frusto-conical object 11, e.g. a frusto-conical concrete pipe.

As illustrated in the figure, a clamping member 1 and a clamping member 2 are rotatably attached to a support member 8 by respective pivot shafts 3'. The upper end of the clamping member 1 is rotatably connected to the lower end of a link member 4 by a pivot shaft 6. Similarly, the upper end of the clamping member 2 is rotatably connected to the lower end of a link member 5 by a pivot shaft 7. The upper ends of the link members 4 and 5 are rotatably connected to each other by a pivot shaft 9.

A suspended ring 12 is secured to the pivot shaft 9. A wire rope 13, for example, is engaged with the suspended ring 12 so that the suspended ring 12 can be lifted and lowered through the wire rope 13.

The clamping member 1, the clamping member 2, the link member 4, the link member 5 and the support member 8 constitute a link mechanism 14 supported at five points.

A lock-unlock mechanism 20 having the structure shown in FIG. 2 is provided to extend between the link member 4 and the support member 8. More specifically, the frame 21 is rotatably attached to the link member 4 by the pin 16, and the guide groove 22 of the frame 21 is pierced with the projecting pin 15 provided on the support member 8.

In the load lifting apparatus arranged as stated above, when the projecting pin 15 lies on the latch 24 shown in FIG. 2 (i.e. when the link mechanism 14 is in a locked state), the clamping members 1 and 2 are in the respective positions R. That is, the distance between the outer sides of the clamping members 1 and 2 is smaller than the inner diameter of the object 11.

In this state, the link mechanism 14 is moved to a position directly above the object 11, and the suspended ring 12 is lowered. Consequently, the support member 8 is placed on the upper end of the object 11. As the suspended ring 12 is further lowered, the frame 21 of the lock-unlock mechanism 20 moves downward. In other words, the projecting pin 15 moves upward in the guide groove 22.

The projecting pin 15 pushes up the shunting member 23. After the projecting pin 15 has passed the shunting member 23, the shunting member 23 returns to come in contact with the stopper pin 26. When the suspended ring 12 is raised after the shunting member 23 has abutted on the stopper pin 26, the link mechanism 14 extends vertically.

Consequently, the distance between the lower ends of the clamping members 1 and 2 enlarges, and the grab members 10 come in contact with the inner wall of the object 11.

When the suspended ring 12 is raised in this state, the object 11 is lifted. After the object 11 has been moved to a desired place, the suspended ring 12 is lowered to release the object 11. The release of the object 11 and the locking of the clamping members 1 and 2 can be effected simply by lowering and raising the suspended ring 12 as stated above.

Therefore, a description thereof is omitted.

It should be noted that the grab members 10 are swingably mounted by respective hinge pins 10*a* so that the grab members 10 can come in close contact with the slanted inner surface of the object.

The lock-unlock mechanism 20 may be replaced by either of the lock-unlock mechanism 50 and 70 having the structures shown in FIGS. 8, 12 to 14. More specifically, the frame 51 or 71 is secured to the link member 4 by the pin 16 (the frame 51 or 71 is not completely fixed but secured such that the frame 51 or 71 is slightly rotatable), and the guide groove 52 or 72 of the frame 51 or 71 is pierced with the projecting pin 15 provided on the support member 8. In this case also, the operation is substantially the same as the above; therefore, a description thereof is omitted.

Figure 16:
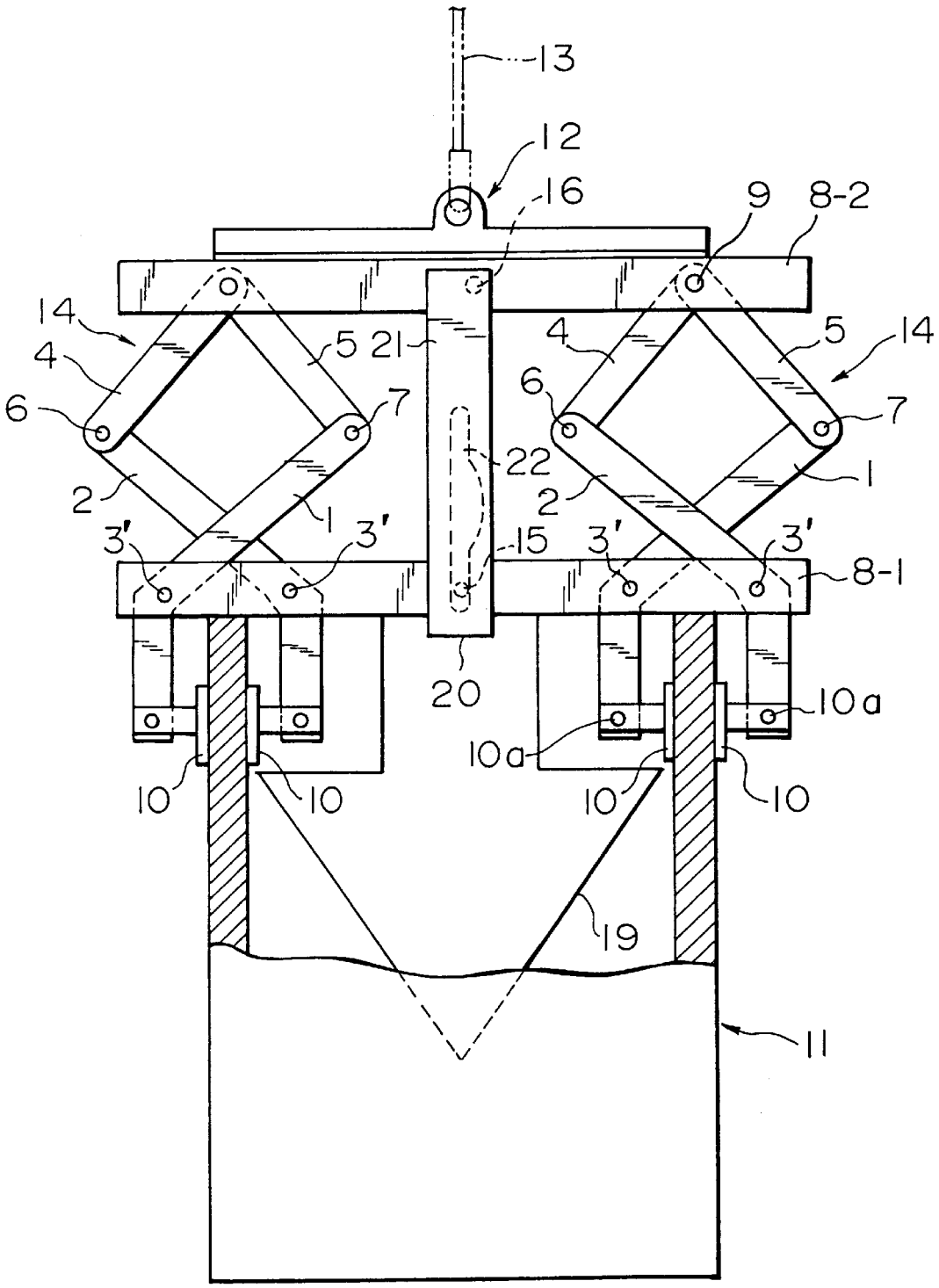
FIG. 16 is a diagram showing an example of a structure of a load lifting apparatus according to the present invention.

FIG. 16 is a diagram showing another structure of a load lifting apparatus according to the present invention. This load lifting apparatus is used to lift a tubular object 11, e.g. a manhole tube, in a vertical position.

As illustrated in the figure, the load lifting apparatus has two link mechanisms 14 each comprising a clamping member 1, a clamping member 2, a link member 4 and a link member 5. The two link mechanisms 14 are provided in a side-by-side relation to each other between a pair of upper and lower support members 8-2 and 8-1. A lock-unlock mechanism 20 having the structure shown in FIG. 2 is provided to extend between the support members 8-2 and 8-1.

FIG. 16 is a diagram showing a state where each wall portion of an object 11 is clamped between grab members 10 attached to the lower ends of the clamping members 1 and 2 of each link mechanism 14, that is, a state where the object 11 is in a lifted state.

It should be noted that reference numeral 19 denotes a guide for guiding the load lifting apparatus when it is lowered onto the object 11 such that the center of the load lifting apparatus, that is, the center line between the two link mechanisms 14, and the center line of the object 11 coincide with each other.

In the above-described state, the object 11 is moved to a desired position, and then the suspended ring 12 is lowered to place the object 11 in the destination. When the suspended ring 12 is further lowered to lower the support member 8-2, the two link mechanisms 14 contract vertically, and each pair of grab members 10 move away from each other to release the object 11.

The projecting pin 15 provided on the lower support member 8-1 moves upward in the guide groove 22. If the suspended ring 12 is raised after the projecting pin 15 has passed the latch 24, each pair of clamping members 1 and 2 are locked in respective positions of rotation about the pivot shafts 3' reached at that time.

The lock-unlock mechanism 20 may be replaced by either of the lock-unlock mechanism 50 and 70 having the structures shown in FIGS. 8, 12 to 14. More specifically, the frame 51 or 71 is secured to the upper support member 8-2 by the pin 16 (the frame 51 or 71 is not completely fixed but secured such that the frame 51 or 71 is slightly rotatable), and the guide groove 52 or 72 of the frame 51 or 71 is pierced with the projecting pin 15 provided on the lower support member 8-1. In this case also, the operation is substantially the same as the above; therefore, a description thereof is omitted.

Figure 17B:
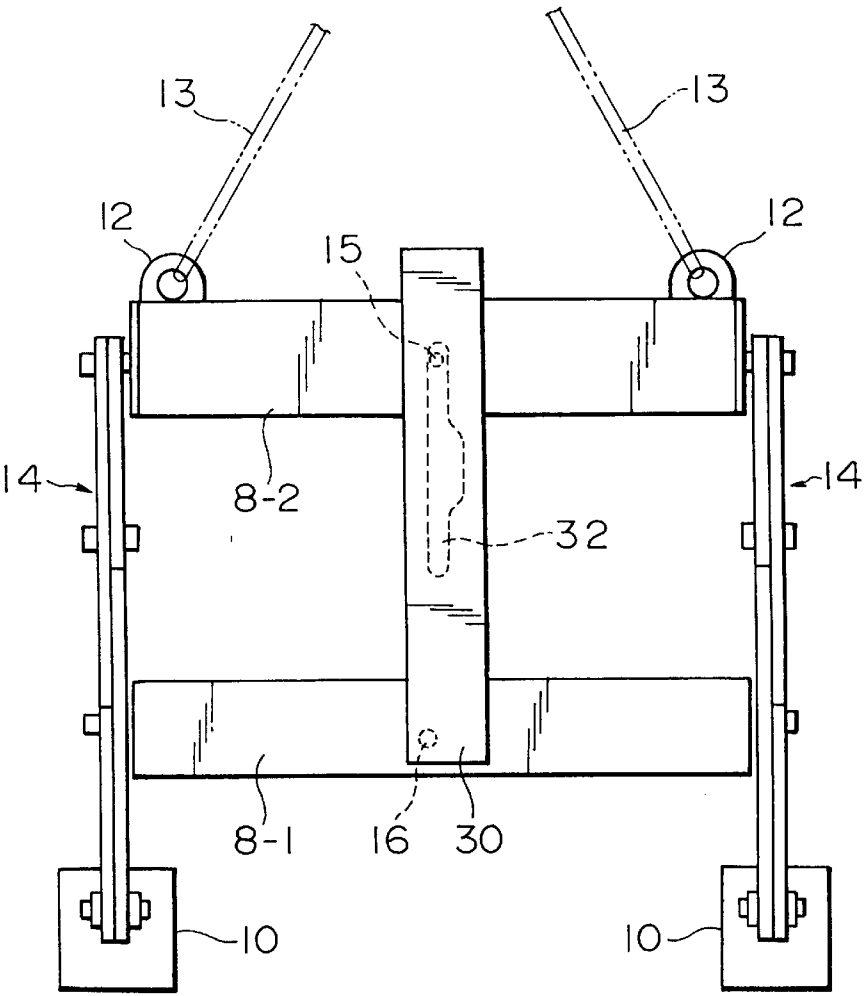
FIGS. 17(*a*) and 17(*b*) are diagrams showing an example of a structure of a load lifting apparatus according to the present invention.
Figure 17A:
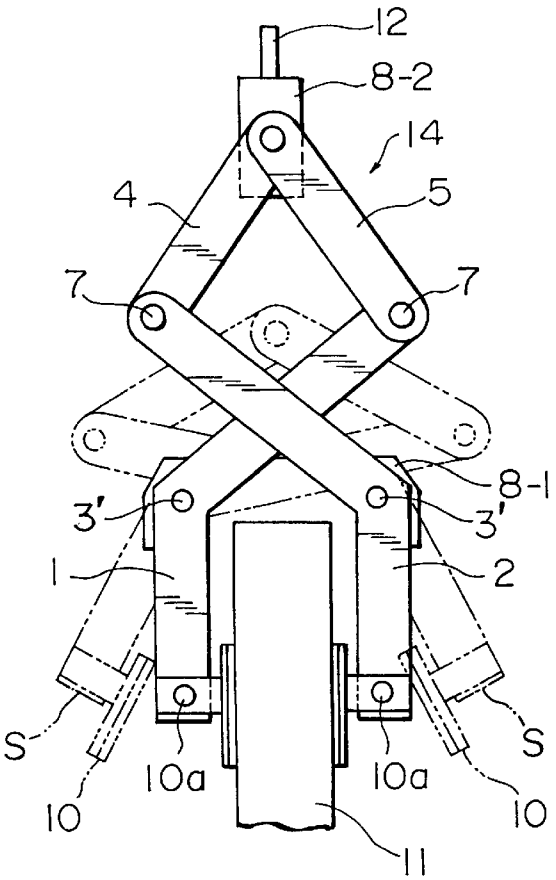

FIGS. 17(*a*) and 17(*b*) are diagrams showing another structure of a load lifting apparatus according to the present invention. This load lifting apparatus is used to lift a plate-shaped object 11, e.g. an L-shaped concrete wall, in a vertical position.

As illustrated in the figures, the load lifting apparatus has two link mechanisms 14 each comprising a clamping member 1, a clamping member 2, a link member 4 and a link member 5. The two link mechanisms 14 are provided to extend between a pair of upper and lower support members 8-2 and 8-1 at both ends of the pair of support members 8-2 and 8-1, respectively. A lock-unlock mechanism 30 having the structure shown in FIG. 4 is provided to extend between the support members 8-2 and 8-1.

FIGS. 17(*a*) and 17(*b*) show a state where each side wall of the object 11 is clamped between grab members 10 attached to the lower ends of the clamping members 1 and 2 of each link mechanism 14, that is, a state where the object 11 is in a lifted state.

In the above-described state, the object 11 is moved to a desired position, and then the suspended rings 12 are lowered to place the object 11 in the destination. When the suspended rings 12 are further lowered to lower the support member 8-2, the two link mechanisms 14 contract vertically, and each pair of grab members 10 move away from each other as indicated by reference character S to release the object 11.

The projecting pin 15 provided on the upper support member 8-2 moves downward in the guide groove 32. If the suspended rings 12 are raised after the projecting pin 15 has passed the latch 34, each pair of clamping members 1 and 2 are locked in respective positions of rotation about the pivot shafts 3' reached at that time.

The lock-unlock mechanism 30 may be replaced by either of the lock-unlock mechanisms 50 and 60 having the structures shown in FIGS. 7, 9 to 11. More specifically, the frame 51 or 61 is secured to the lower support member 81 by the pin 16 (the frame 51 or 61 is not completely fixed but secured such that the frame 51 or 61 is slightly rotatable), and the guide groove 52 or 62 of the frame 51 or 61 is pierced with the projecting pin 15 provided on the upper support member 8-2. In this case also, the operation is substantially the same as the above; therefore, a description thereof is omitted.

Figure 18B:
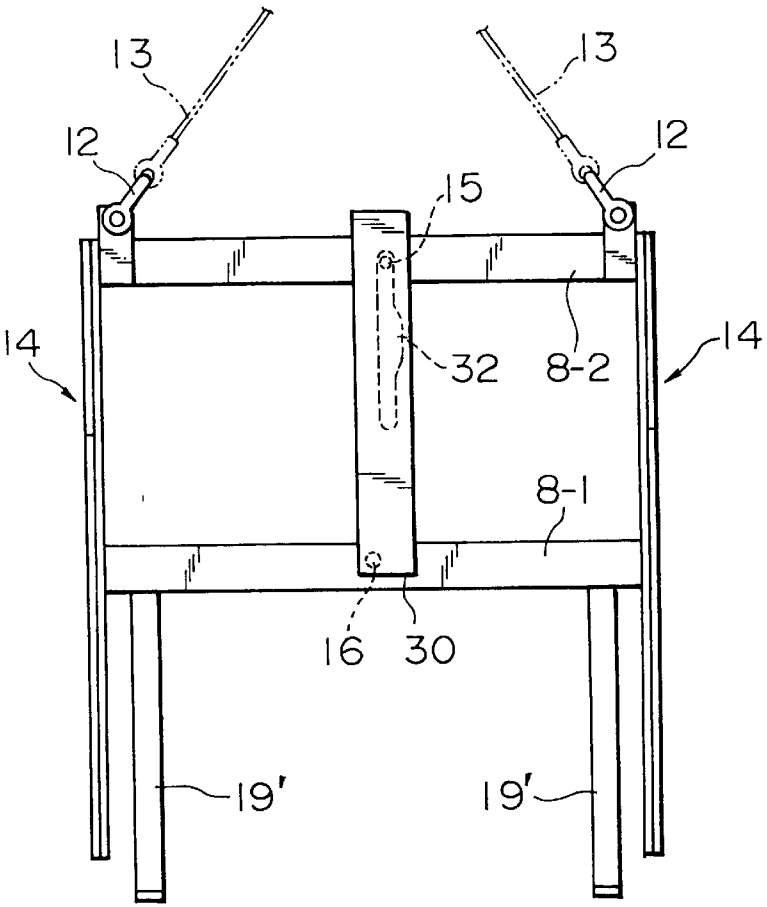
FIGS. 18(*a*) and 18(*b*) are diagrams showing an example of a structure of a load lifting apparatus according to the present invention.
Figure 18A:
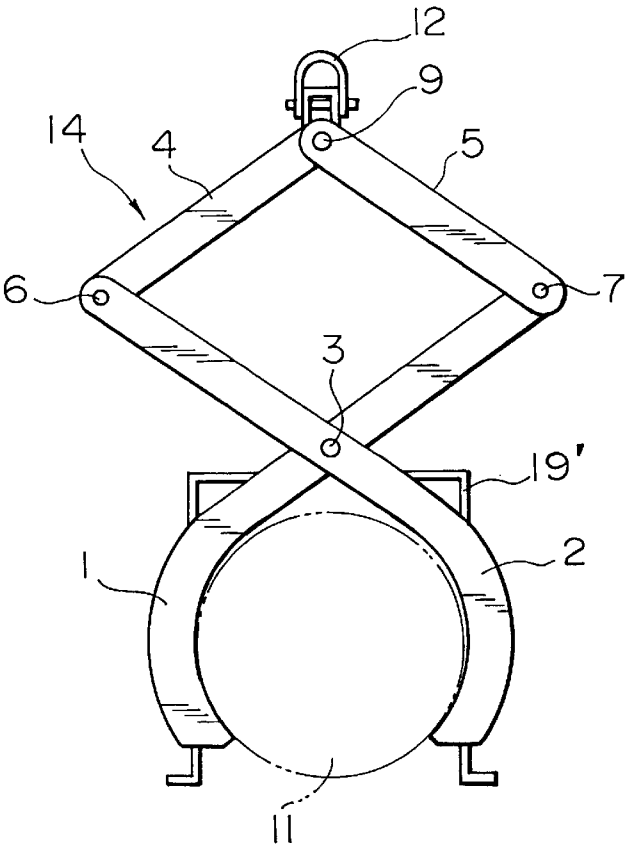

FIGS. 18(*a*) and 18(*b*) are diagrams showing another structure of a load lifting apparatus according to the present invention. This load lifting apparatus is used to lift a tubular object 11 of continuous length, e.g. a concrete pipe or steel pipe, in a horizontal position.

As illustrated in the figures, the load lifting apparatus has two link mechanisms 14 each comprising a clamping member 1 with an arc-shaped distal end portion, a clamping member 2 with an arc-shaped distal end portion, a link member 4 and a link member 5. The two link mechanisms 14 are provided to extend between a pair of upper and lower support members 8-2 and 8-1 at both ends of the pair of support members 8-2 and 8-1, respectively. A lock-unlock mechanism 30 having the structure shown in FIG. 4 is provided between the support members 8-2 and 8-1.

FIGS. 18(*a*) and 18(*b*) show a state where the tubular object 11 is grasped by the clamping members 1 and 2 of the two link mechanisms 14, that is, a state where the object 11 is in a lifted state.

In the above-described state, the object 11 is moved to a desired position, and then the suspended rings 12 are lowered to place the object 11 in the destination. When the suspended rings 12 are further lowered to lower the support member 8-2, the two link mechanisms 14 contract vertically, and the arc-shaped portions of the clamping members 1 and 2 move away from each other to release the object 11.

The projecting pin 15 provided on the upper support member 8-2 moves downward in the guide groove 32. If the suspended rings 12 are raised after the projecting pin 15 has passed the latch 34, each pair of clamping members 1 and 2 are locked in respective positions of rotation about the pivot shaft 3 reached at that time.

The lock-unlock mechanism 30 may be replaced by either of the lock-unlock mechanisms 50 and 60 having the structures shown in FIGS. 7, 9 to 11. More specifically, the frame 51 or 61 is secured to the lower support member 81 by the pin 16 (the frame 51 or 61 is not completely fixed but secured such that the frame 51 or 61 is slightly rotatable), and the guide groove 52 or 62 of the frame 51 or 61 is pierced with the projecting pin 15 provided on the upper support member 8-2. In this case also, the operation is substantially the same as the above; therefore, a description thereof is omitted.

It should be noted that the foregoing structures of load clamping and lifting apparatuses and lock-unlock mechanisms are embodiments of the present invention, and that the present invention is not necessarily limited thereto. The embodiments can be modified in various ways according to the structure, shape, weight, etc. of an object to be handled.

As has been described above, the load clamping and lifting apparatus according to the present invention has a lock-unlock mechanism that is actuated in response to the vertical extension and contraction of a link mechanism, which is caused by vertical movement of a lifting device, to lock the clamping members in respective predetermined positions of rotation about the pivot shaft and to unlock the clamping members in response to the vertical movement of the lifting device. Accordingly, a series of operations, i.e. grasping of a load, lifting, movement, release of the load, and locking of the clamping members in respective predetermined positions of rotation about the pivot shaft, can be executed by only the vertical movement of the lifting device without requiring human power. Thus, it is advantageously possible to achieve an efficient and labor-saving materials-handling operation.

What we claim is:

1. A load clamping and lifting apparatus comprising a link mechanism in which a pair of clamping members and a plurality of members are supported by a plurality of pivot shafts, wherein an upper part of said link mechanism is capable of being lifted and lowered by lifting means, and said clamping members rotate about a pivot shaft in response to vertical extension and contraction of said link mechanism, thereby enabling an object to be grasped by distal end portions of said clamping members by the extension of said link mechanism, and allowing said object to be released from the distal end portions of said clamping members by the contraction of said link mechanism, said apparatus further comprising a lock-unlock mechanism actuated in response to the vertical extension and contraction of said link mechanism, which is caused by vertical movement of said lifting means, to lock said clamping members in respective predetermined positions of rotation about said pivot shaft and to unlock said clamping members in response to the vertical movement of said lifting means;

wherein said lock-unlock mechanism has a frame provided with a straight-line shaped guide groove, a latch member having a latch projection and a projection for rotation, limiting means for limiting rotation in a predetermined direction of said latch member, and holding means for holding said latch member in a predetermined rotational position;

wherein said frame is attached to a member constituting said link mechanism or to a member that moves in response to extension and contraction of said link mechanism, and said guide groove is pierced with a projecting pin provided on a member constituting said link mechanism or on a member that moves in response to extension and contraction of said link mechanism, said projecting pin being moveable in said guide groove;

wherein said latch member is rotatably supported on said frame by a pivot shaft such that a distal end of said latch projection projects into said guide groove so that said latch member is rotated by movement of said projecting pin in one direction, and such that said projection for rotation extends across said guide groove, and rotation of said latch member is limited by said limiting means; and wherein said latch member is arranged such that after said projecting pin has moved in said guide groove in said one direction past said latch projection, movement of said projecting pin in said opposite direction is limited by said latch projection, and when said projecting pin pushes said projection for rotation after moving further in said one direction, said latch member rotates to a predetermined position and is held at said position by said holding means, and thereafter, said latch member is released from said holding means by movement of said projecting pin in said opposite direction and rotated to a position where rotation of said latch member is limited by said limiting means.

* * * * *